US011613439B2

(12) United States Patent
Yokota et al.

(10) Patent No.: US 11,613,439 B2
(45) Date of Patent: Mar. 28, 2023

(54) SHEET FEEDING APPARATUS AND IMAGE FORMING APPARATUS

(71) Applicant: CANON KABUSHIKI KAISHA, Tokyo (JP)

(72) Inventors: Akinori Yokota, Tokyo (JP); Tomoya Tateishi, Kanagawa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 153 days.

(21) Appl. No.: 17/124,632

(22) Filed: Dec. 17, 2020

(65) Prior Publication Data

US 2021/0188574 A1 Jun. 24, 2021

(30) Foreign Application Priority Data

Dec. 23, 2019 (JP) ..... JP2019-231458

(51) Int. Cl.

| | |
|---|---|
| ***B65H 3/56*** | (2006.01) |
| ***B65H 3/06*** | (2006.01) |
| ***G03G 15/00*** | (2006.01) |
| ***B65H 1/04*** | (2006.01) |
| ***B65H 3/46*** | (2006.01) |

(52) U.S. Cl.

CPC ..... *B65H 3/565* (2013.01); *B65H 1/04* (2013.01); *B65H 3/0607* (2013.01); *B65H 3/0669* (2013.01); *B65H 3/46* (2013.01); *G03G 15/6511* (2013.01)

(58) Field of Classification Search

CPC ..... B65H 1/04; B65H 3/0669; B65H 3/0684; B65H 3/24; B65H 3/34; B65H 3/46; B65H 3/56; B65H 3/565; B65H 2403/512; B65H 2403/514

See application file for complete search history.

(56) References Cited

U.S. PATENT DOCUMENTS

| | | | | |
|---|---|---|---|---|
| 10,214,373 | B2 * | 2/2019 | Sata | G03G 15/6511 |
| 2016/0257511 | A1 * | 9/2016 | Machida | B65H 1/04 |
| 2016/0355358 | A1 * | 12/2016 | Murakami | B65H 3/0684 |
| 2019/0193964 | A1 * | 6/2019 | Murakami | B65H 1/24 |

FOREIGN PATENT DOCUMENTS

| | | | |
|---|---|---|---|
| JP | H8-310692 | A | 11/1996 |
| JP | H9-202475 | A | 8/1997 |
| JP | H10-226428 | A | 8/1998 |
| JP | 2018-62399 | A | 4/2018 |

* cited by examiner

*Primary Examiner* — Prasad V Gokhale
(74) *Attorney, Agent, or Firm* — Venable LLP

(57) ABSTRACT

A sheet feeding apparatus includes a regulator to regulate a position of leading edges of first and second sheets supported on a sheet support. A drive transmission drives a return for returning the second sheet toward the sheet support and the regulator by a driving force, wherein the return includes a first cam follower, a first pivot shaft, and a claw supported pivotably around the first pivot shaft. The drive transmission includes a first cam to drive the return by engaging with the first cam follower and rotating, and the regulator includes a second pivot shaft that is parallel to the first pivot shaft. The regulating member includes the regulating surface and is arranged such that at least a portion of the regulating member is overlapped with the claw in an axial direction of the second pivot shaft.

14 Claims, 16 Drawing Sheets

SHEET FEEDING APPARATUS AND IMAGE FORMING APPARATUS

BACKGROUND OF THE INVENTION

Field of the Invention

The present invention relates to a sheet feeding apparatus for feeding sheets, and an image forming apparatus equipped with the sheet feeding apparatus.

Description of the Related Art

Hitherto, there has been proposed a sheet feeding apparatus having a pickup roller for feeding sheets that have been supported on a manual feed tray, and a conveyance roller and a separation roller that separate one sheet fed by the pickup roller from other sheets (refer to Japanese Patent Application Laid-Open Publication No. 2018-62399). The sheet feeding apparatus includes a return claw that is supported rotatably and designed to stand by at a standby position. The sheet having been separated by the conveyance roller and the separation roller is returned to the manual feed tray by the return claw pivoting from the standby position. Thereby, multiple feeding of sheets is reduced and feeding performance is improved.

Further, the return claw includes an abutting surface against which a leading edge of the sheet supported on the manual feed tray abuts when the return claw is at the standby position. The abutting surface regulates the position of the leading edges of the sheets set on the manual feed tray.

However, the abutting surface of the return claw described in Japanese Patent Application Laid-Open Publication No. 2018-62399 has a leading edge portion that is curved so that the sheet separated by the conveyance roller and the separation roller is returned to the manual feed tray without fail. Thus, the sheets inserted to the manual feed tray are aligned against the abutting surface to be set on the tray, so that there was a drawback in the setting property of sheets.

SUMMARY OF THE INVENTION

According to one aspect of the present invention, a sheet feeding apparatus includes a sheet supporting portion configured to support a first sheet and a second sheet that are superposed in a stacking direction, a rotary feeding member configured to feed the first sheet supported on the sheet supporting portion, a separation portion configured to separate the second sheet fed by following the first sheet from the first sheet, a return portion configured to return the second sheet, separated by the separation portion from the first sheet, toward the sheet supporting portion, and a regulating portion comprising a regulating surface configured to regulate a position of leading edges of the first sheet and the second sheet supported on the sheet supporting portion, the regulating portion being configured to move between a regulating position configured to regulate the position of leading edges of the first sheet and the second sheet by the regulating surface, and an allowing position being configured to allow feeding of the first sheet and the second sheet supported on the sheet supporting portion, the regulating surface being extended in the stacking direction in a state where the regulating portion is positioned at the regulating position.

Further features of the present invention will become apparent from the following description of exemplary embodiments with reference to the attached drawings.

DESCRIPTION OF THE EMBODIMENTS

First Embodiment

Figure 1:
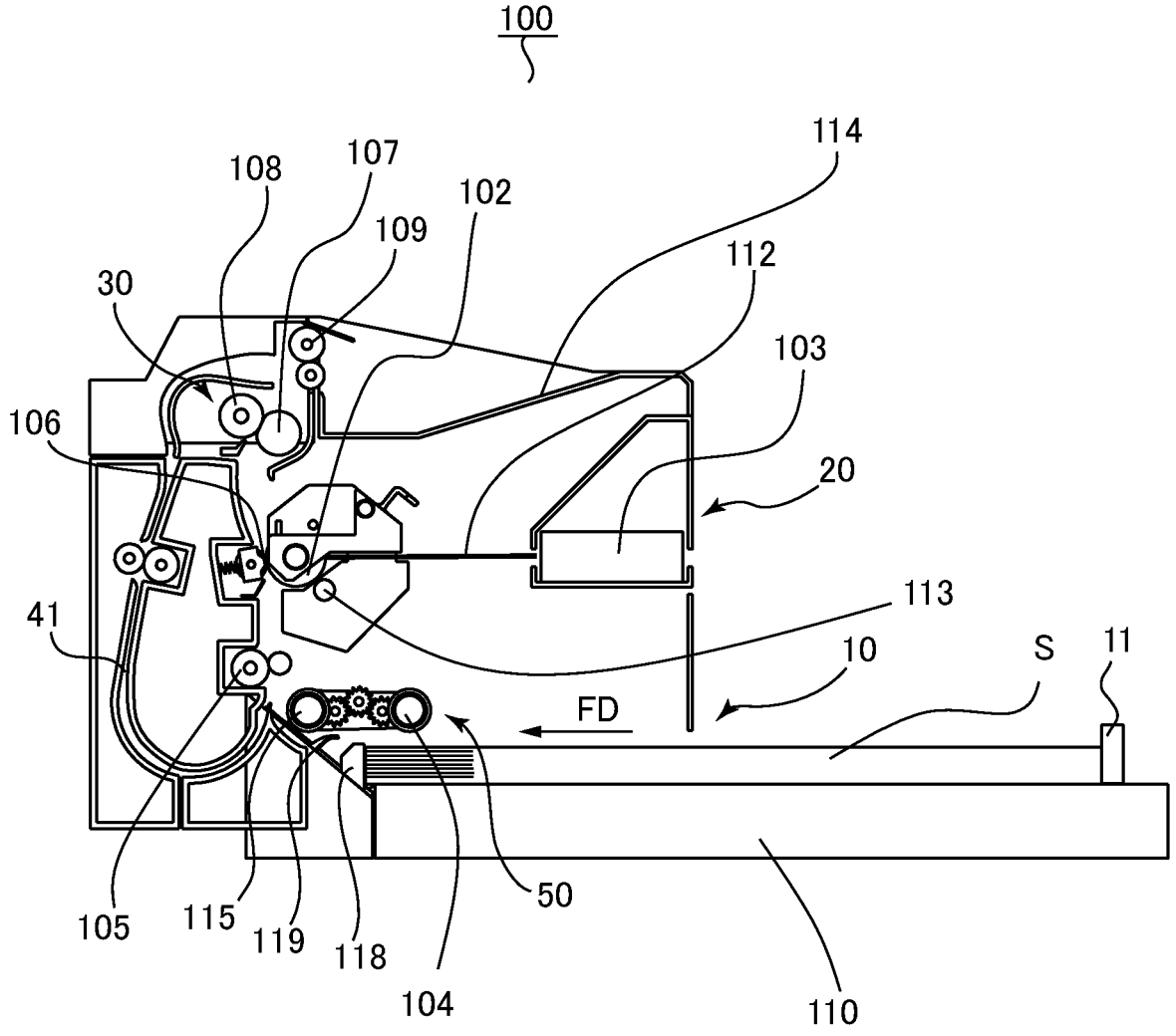
FIG. 1 is an entire schematic diagram illustrating a printer according to a first embodiment.

Now, a first embodiment according to the present invention will be described. A printer 100 serving as an image forming apparatus according to a first embodiment is a laser beam printer adopting an electrophotographic system. As illustrated in FIG. 1, the printer 100 includes a sheet feeding apparatus 10 provided at a lower portion of the printer 100, an image forming unit 20 that forms an image on a sheet S fed by the sheet feeding apparatus 10, a fixing unit 30, and a sheet discharge roller pair 109.

In a state where an image forming command is output to the printer 100, an image forming process by the image forming unit 20 is started based on image information entered from an external computer and the like connected to the printer 100. The image forming unit 20 includes a photosensitive drum 102 serving as an image bearing member, a developing roller 113, a laser scanner 103, and a transfer roller 106. The laser scanner 103 irradiates laser light 112 toward the photosensitive drum 102 based on the entered image information. In this state, the photosensitive drum 102 is charged in advance by a charging roller not shown, and electrostatic latent image is formed on the photosensitive drum 102 by having the laser light 112 irradiated thereto. Thereafter, the electrostatic latent image is developed by the developing roller 113, and a toner image is formed on the photosensitive drum 102.

In parallel with the image forming process described above, the sheet S is fed by the sheet feeding apparatus 10. The sheet S fed by the sheet feeding apparatus 10 is conveyed by a conveyance roller pair 105 toward the transfer roller 106. A toner image formed on the photosensitive drum 102 is transferred to the sheet S by having transfer bias applied to the transfer roller 106.

The sheet S to which the toner image has been transferred by the transfer roller 106 is heated and pressed by the fixing unit 30. The fixing unit 30 for fixing the toner image is composed of a heating roller 107 having a heater embedded therein, and a pressure roller 108 urged toward the heating roller 107. The sheet S is discharged by the sheet discharge roller pair 109 to a sheet discharge tray 114.

If images are to be formed on both sides of the sheet S, the sheet discharge roller pair 109 subjects the sheet S having an image formed on a first side to switch-back and guides the sheet S to a duplex conveyance path 41. The sheet S having passed through the duplex conveyance path 41 and having an image formed on a second side by the transfer roller 106 is discharged from the apparatus by the sheet discharge roller pair 109.

Sheet Feeding Apparatus

Figure 2:
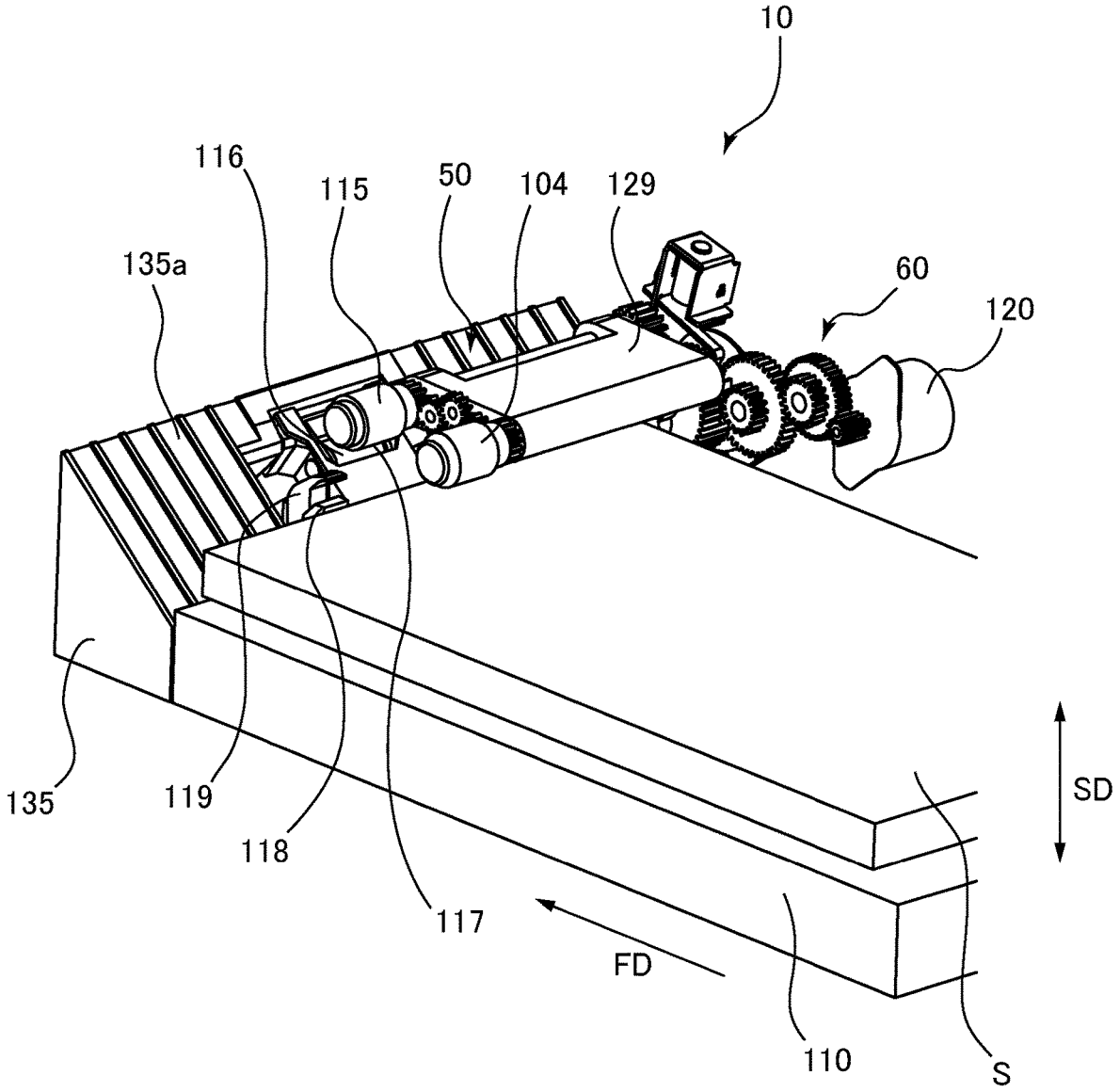
FIG. 2 is a perspective view illustrating a sheet feeding apparatus.

Next, the configuration of the sheet feeding apparatus 10 will be described in detail. As illustrated in FIGS. 1 and 2, the sheet feeding apparatus 10 includes a supporting tray 110 on which sheets are stacked and supported, and a feeding portion 50 that feeds the sheets S supported on the supporting tray 110. The sheet feeding apparatus 10 includes a leading edge regulating portion 118, a return claw 119, a trailing edge regulating plate 11, and a drive transmission portion 60 that drives the feeding portion 50, the leading edge regulating portion 118 and the return claw 119 by driving a motor 120 serving as a driving source.

The sheet S supported on the supporting tray 110 has its leading edge position regulated by the leading edge regulating portion 118 and its trailing edge position regulated by the trailing edge regulating plate 11. The trailing edge regulating plate 11 is supported movably in a sheet feeding direction FD with respect to the supporting tray 110, and the position of the trailing edge regulating plate 11 is determined by a user in correspondence to the size of the sheet S.

The feeding portion 50 includes a feeding roller 104 that contacts a stacked sheet S and feeds the same, a conveyance roller 115 that conveys the sheet S fed by the feeding roller 104, and a separation roller 116 that forms a separation nip 117 with the conveyance roller 115. Further, the feeding portion 50 includes a feeding holder 129 that is supported swingably around a conveyance roller shaft 115*a* (refer to FIG. 6) and that supports the feeding roller 104 rotatably, and a conveyance guide 135 that guides the sheet S. The conveyance guide 135 includes an inclined plane 135*a* that is inclined with respect to the sheet feeding direction FD and a stacking direction SD and that slides against the sheet S fed by the feeding roller 104. The sheet S slides against the inclined plane 135*a* and is separated from other sheets.

The return claw 119 serving as a return portion returns the sheet separated from an uppermost sheet by the separation nip 117 toward the supporting tray 110 serving as a sheet supporting portion. Thereby, multiple feeding of sheets S is reduced, and stable feeding performance is obtained.

In the present embodiment, the separation nip 117 for separating a sheet from other sheets is formed by the conveyance roller 115 and the separation roller 116, but the present invention is not limited thereto. For example, a separating pad can be adopted instead of the separation roller 116. In addition, a configuration of a torque limiter or a retard roller is adopted in the separation roller 116.

Drive Transmission Portion

Figure 3A:
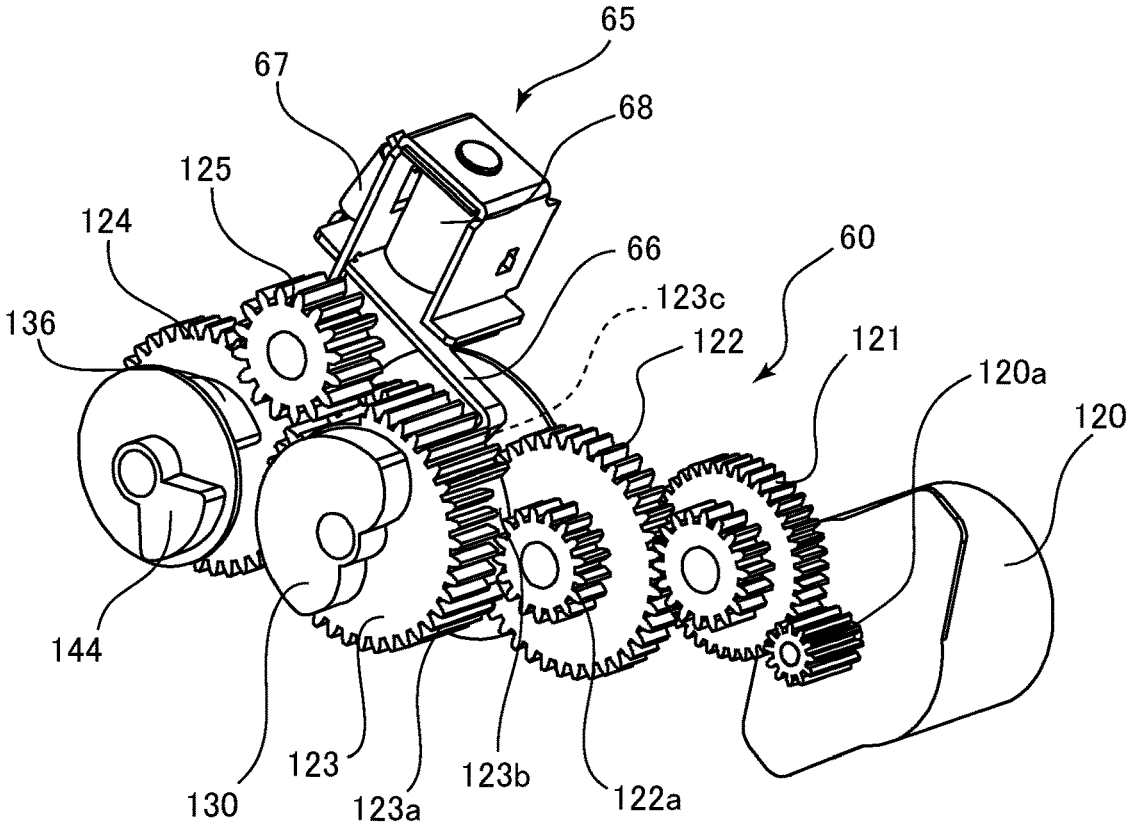
FIG. 3A is a perspective view illustrating a drive transmission portion.
Figure 3B:
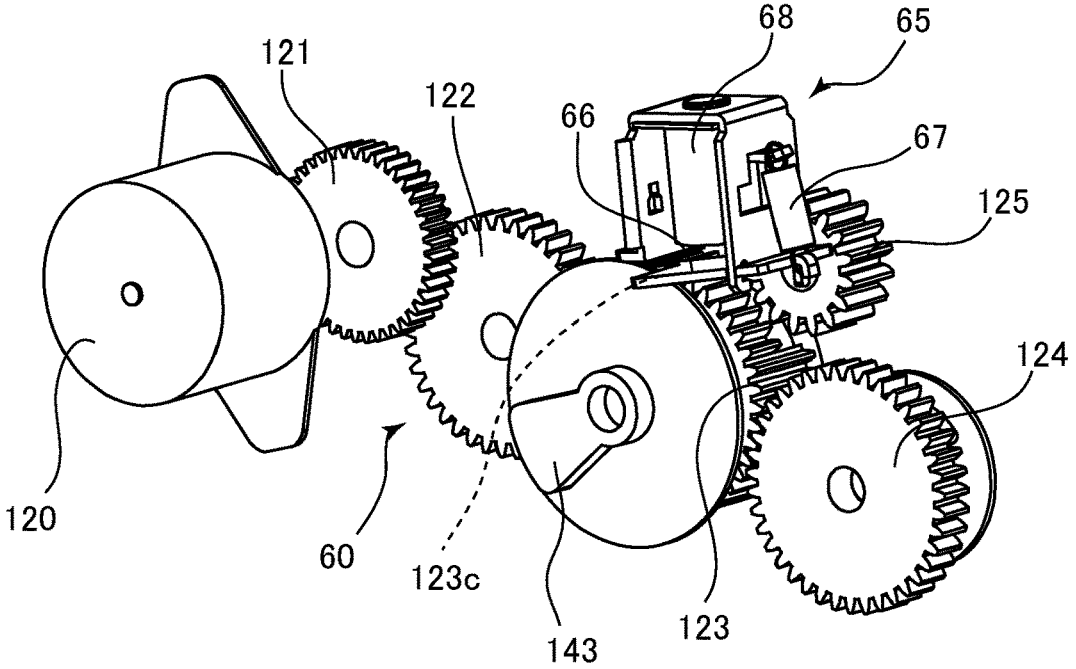
FIG. 3B is a perspective view illustrating the drive transmission portion.

Next, the drive transmission portion 60 will be described in detail. As illustrated in FIGS. 3A and 3B, the drive transmission portion 60 includes a pinion gear 120*a* driven by the motor 120, a first drive gear 121 meshed with the pinion gear 120*a*, and a second drive gear 122 meshed with the first drive gear 121.

The drive transmission portion 60 includes a chipped tooth gear 123 that is rotated by the second drive gear 122, a solenoid unit 65 that positions the chipped tooth gear 123 at a standby position, and a separation gear 124 and a conveyance gear 125 that are meshed with the chipped tooth gear 123.

The chipped tooth gear 123 includes a gear portion 123*a* having a plurality of gear teeth and a chipped tooth portion 123*b* where the gear teeth are not formed, wherein the chipped tooth portion 123*b* is opposed to an output gear 122*a* of the second drive gear 122 in a state where the chipped tooth gear 123 is positioned at the standby position. The separation gear 124 and the conveyance gear 125 are meshed with the gear portion 123*a* of the chipped tooth gear 123. The separation gear 124 includes the same number of teeth as the gear portion 123*a* of the chipped tooth gear 123.

The solenoid unit 65 includes an engagement claw 66 engageable with an engagement portion 123*c* formed on a part of a circumference surface of the chipped tooth gear 123, a spring 67 that urges the engagement claw 66 toward a direction to engage with the engagement portion 123*c*, and a solenoid 68. By energizing the solenoid 68, the engagement claw 66 is moved to swing away from the engagement portion 123*c* against the urging force of the spring 67.

In a state where an image forming job is entered to the printer 100, the motor 120 is driven, and the pinion gear 120*a*, the first drive gear 121 and the second drive gear 122 are rotated. In this state, the chipped tooth gear 123 is positioned at a standby position illustrated in FIGS. 3A and 3B by the engagement claw 66 of the solenoid unit 65, and the chipped tooth portion 123*b* of the chipped tooth gear 123 is opposed to the output gear 122*a* of the second drive gear 122. Therefore, driving force is not transmitted from the second drive gear 122 to the chipped tooth gear 123.

When the solenoid 68 of the solenoid unit 65 is energized, the engagement claw 66 is separated from the engagement portion 123*c* of the chipped tooth gear 123 against the urging force of the spring 67. Then, the chipped tooth gear 123 is rotated for a predetermined angle by a spring not shown provided in the chipped tooth gear 123, and the gear portion 123*a* meshes with the output gear 122*a* of the second drive gear 122. Thereby, the chipped tooth gear 123 rotates by the driving force of the second drive gear 122, and the separation gear 124 and the conveyance gear 125 meshed with the chipped tooth gear 123 rotate. When the chipped tooth gear 123 rotates once and returns to the standby position, the engagement claw 66 urged by the spring 67 is engaged with the engagement portion 123*c* and the chipped tooth gear 123 is retained at the standby position.

As described, since the solenoid 68 is energized in a state where the motor 120 is driven, the chipped tooth gear 123 is controlled to rotate once. The separation gear 124 and the conveyance gear 125 are rotated only while the chipped tooth gear 123 is rotating.

Figure 4:
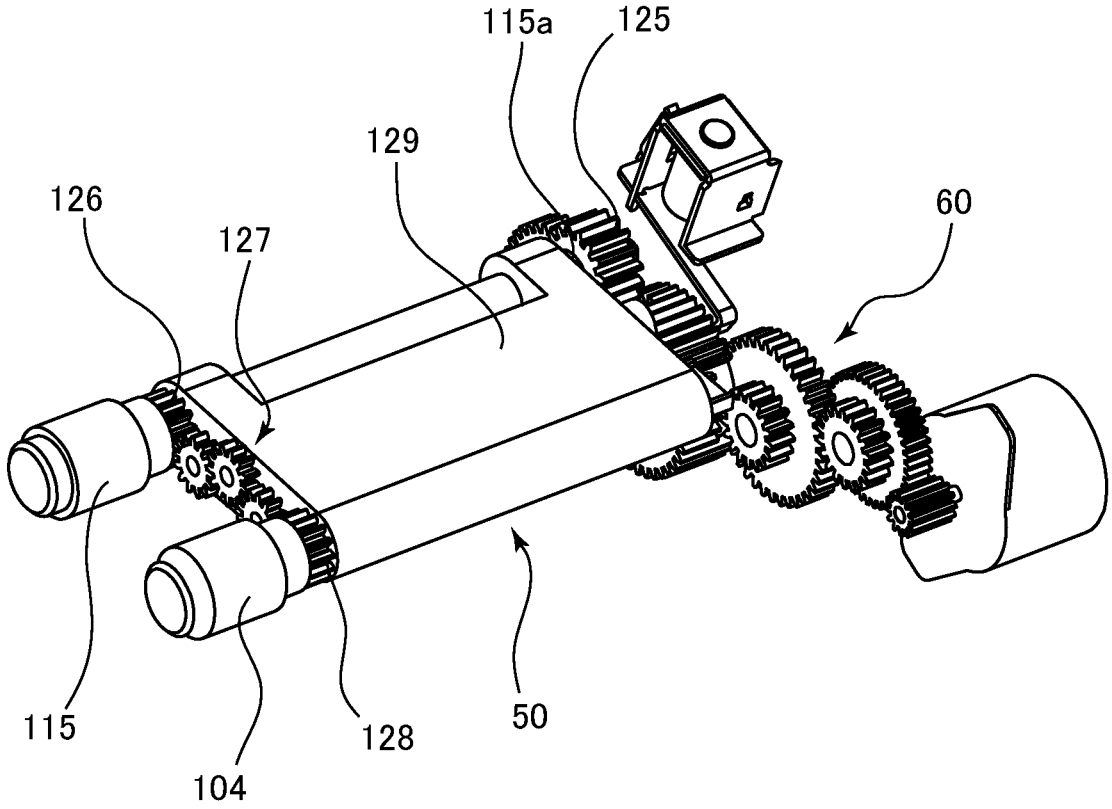
FIG. 4 is a perspective view illustrating a feeding portion.

As illustrated in FIG. 4, the conveyance gear 125 is fixed to the conveyance roller shaft 115*a* to which the conveyance roller 115 is mounted, and the conveyance roller 115 is rotated by the rotation of the conveyance gear 125. A gear 126 is fixed to the conveyance roller shaft 115*a*, and the gear 126 transmits drive via an idler gear train 127 to a feeding gear 128. The feeding gear 128 is fixed to a rotation shaft not shown of the feeding roller 104, and the feeding roller 104 rotates by the rotation of the feeding gear 128. As described, the feeding roller 104 and the conveyance roller 115 are rotated by the rotation of the conveyance gear 125.

Lifting and Lowering Operation of Feeding Roller

Figure 5:
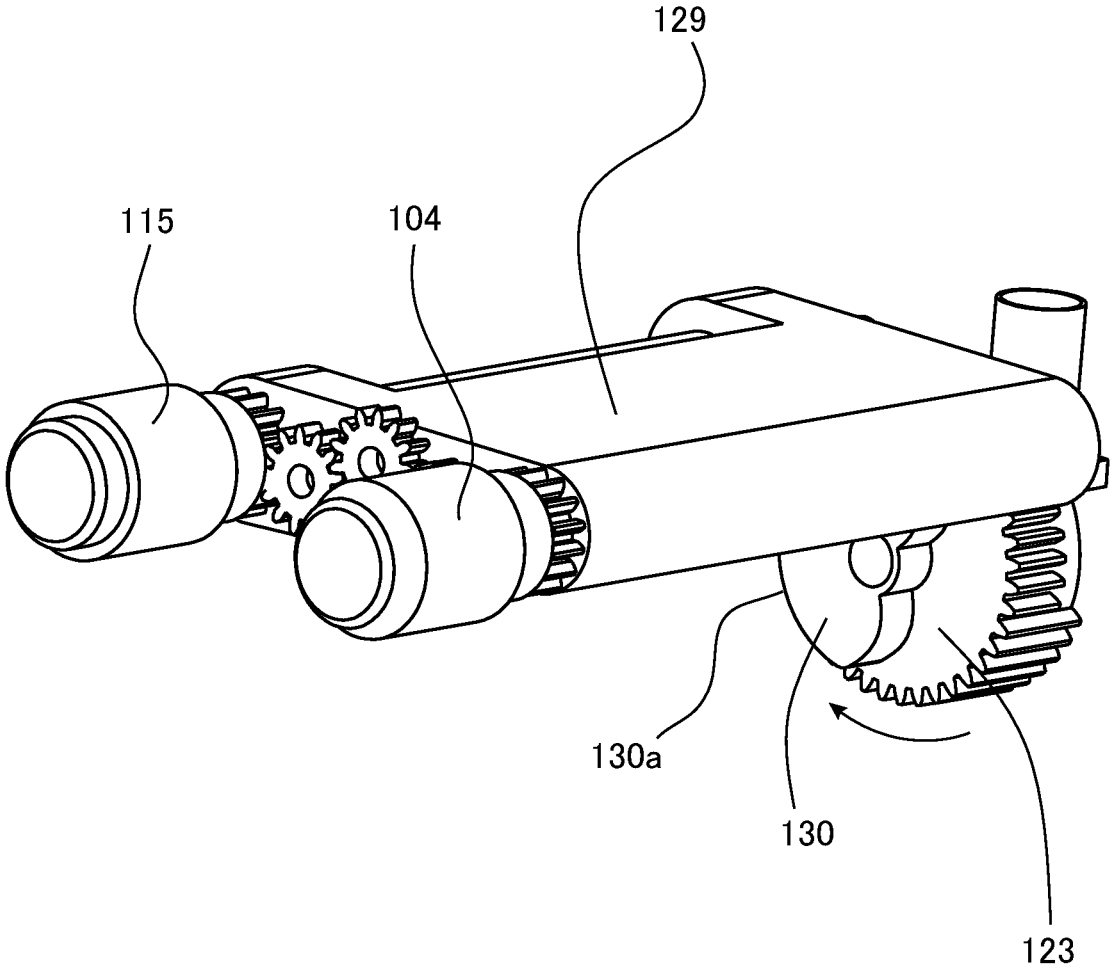
FIG. 5 is an enlarged perspective view of the feeding portion.
Figure 6:
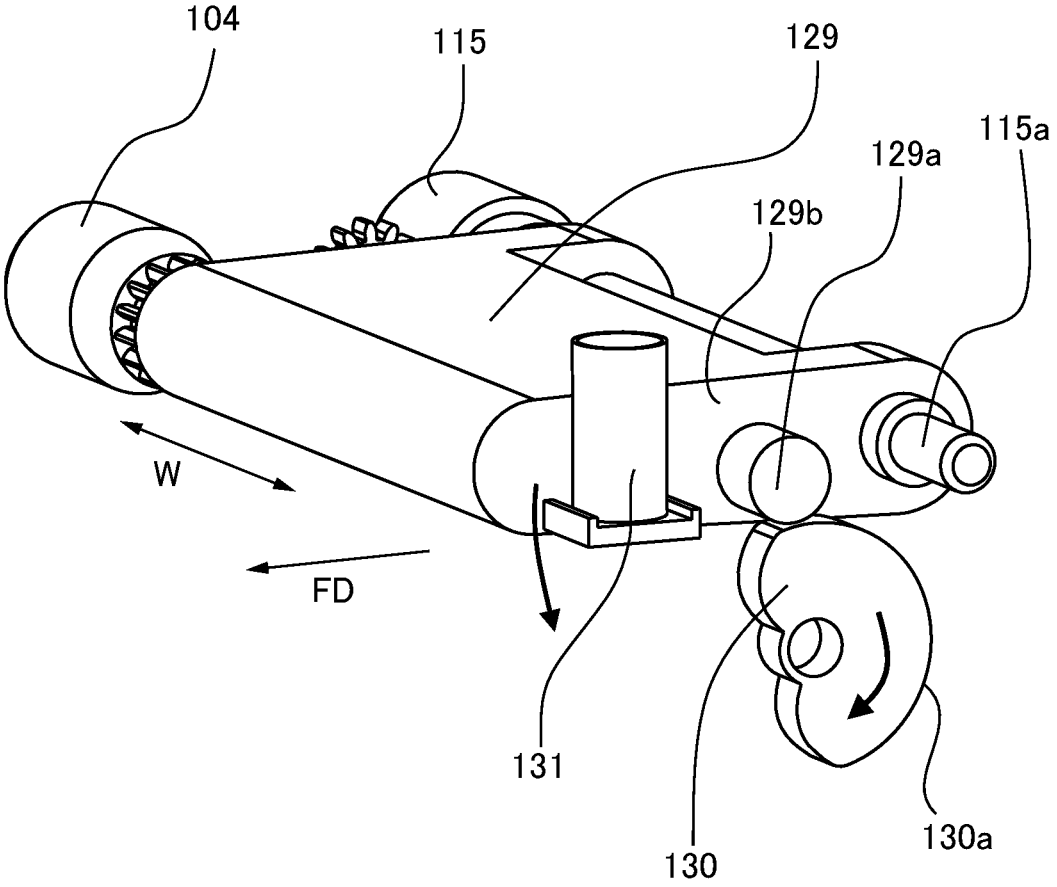
FIG. 6 is a perspective view illustrating the feeding portion and a feeding cam.

Next, the peripheral configuration and lifting and lowering operation of the feeding roller 104 will be described. As illustrated in FIGS. 3A, 5 and 6, a feeding cam 130 that rotates integrally with the chipped tooth gear 123 is mounted to a side surface of the chipped tooth gear 123. Further, a contact portion 129*a* is protruded from a side surface 129*b* of the feeding holder 129 in a width direction W, i.e., axial direction, that is orthogonal to the sheet feeding direction FD.

In a state where the feeding holder 129 is positioned at a lifted position, the contact portion 129*a* is in contact with a cam surface 130*a* of the feeding cam 130. The feeding holder 129 is urged downward by a feeding spring 131. That is, in a state where the feeding holder 129 is positioned at the lifted position, the contact portion 129*a* is pressed against the cam surface 130*a* by the urging force of the feeding spring 131. In a state where the feeding holder 129 is positioned at the lifted position, the feeding roller 104 retained by the feeding holder 129 is separated from the sheet S supported on the supporting tray 110 (refer to FIG. 1).

When the chipped tooth gear 123 rotates and the feeding cam 130 is rotated therewith, the engagement between the cam surface 130*a* of the feeding cam 130 and the contact portion 129*a* is cancelled, and the feeding holder 129 pivots downward around the conveyance roller shaft 115*a* by the feeding spring 131. Thereby, the feeding roller 104 retained by the feeding holder 129 contacts the sheet S, and the sheet S is fed by the feeding roller 104 that serves as a rotary feeding member.

When the feeding cam 130 is rotated further, the contact portion 129*a* is engaged again with the cam surface 130*a*, and the feeding holder 129 is pivoted to the lifted position. In a state where the feeding holder 129 is positioned at the lifted position, the chipped tooth gear 123 is stopped at the standby position by the solenoid unit 65. That is, in a state where the chipped tooth gear 123 and the feeding cam 130 rotate once, the feeding roller 104 is transited from a separated state to a contact state and then again to the separated state with respect to the sheet S.

Separation Operation of Separation Roller

Figure 7:
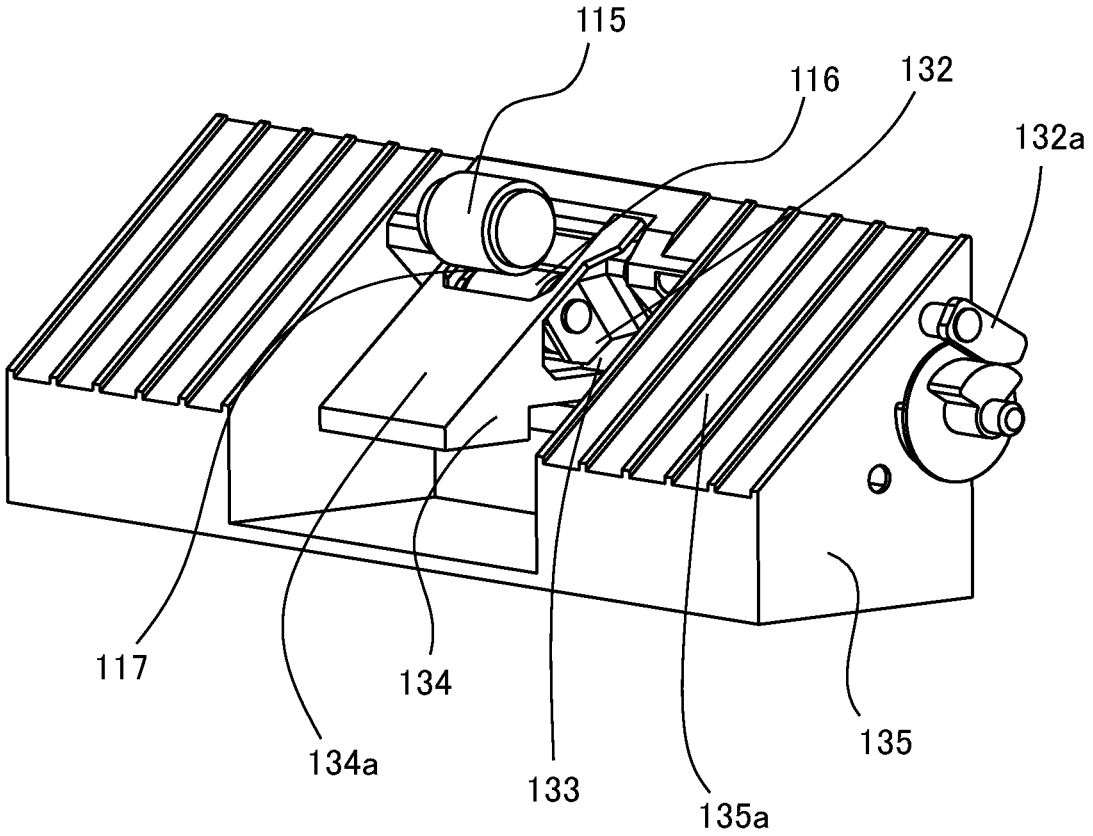
FIG. 7 is a perspective view illustrating a peripheral configuration of a separation roller.
Figure 8A:
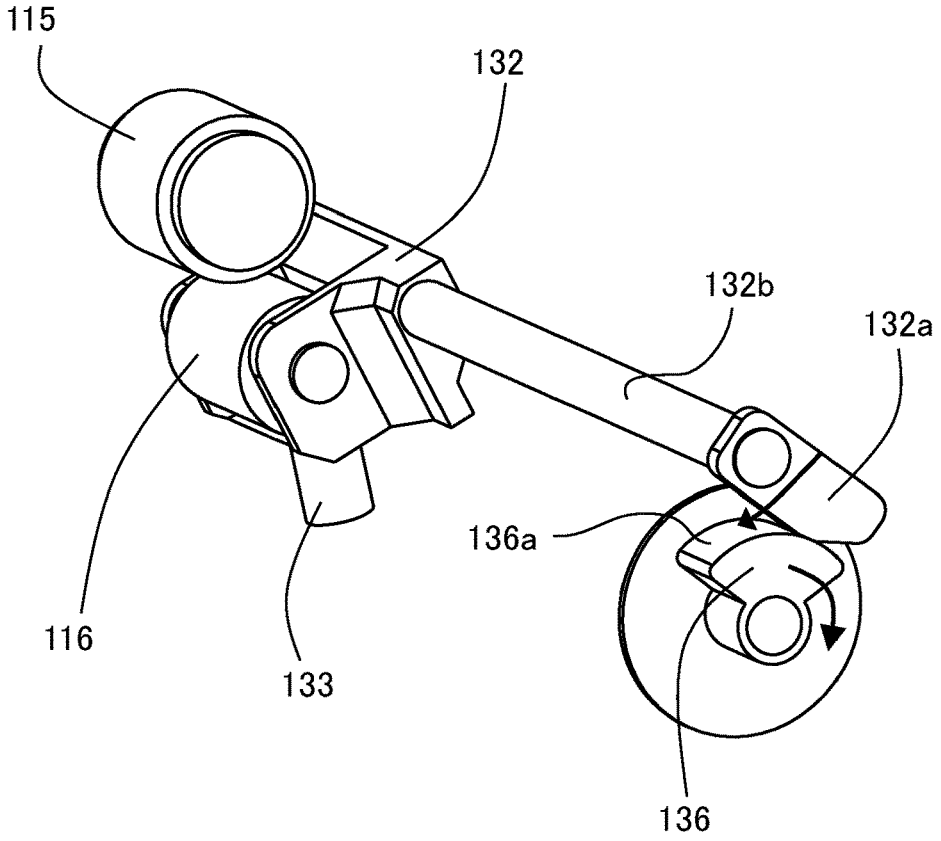
FIG. 8A is a perspective view illustrating the separation roller positioned at a separation position and a peripheral configuration thereof.
Figure 8B:
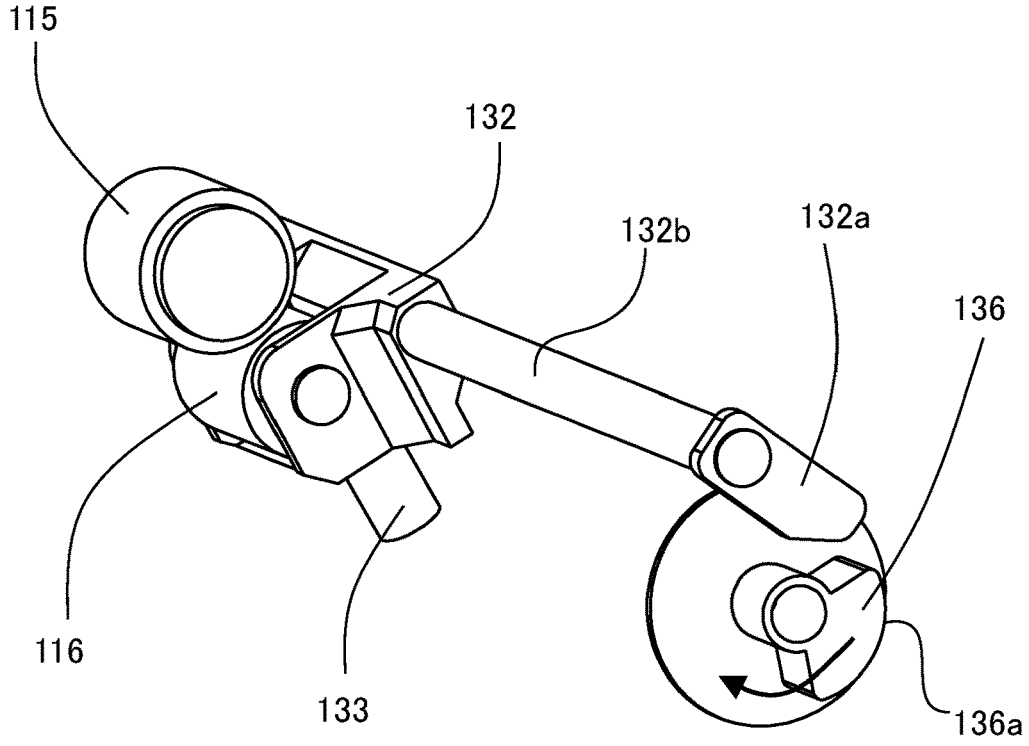
FIG. 8B is a perspective view illustrating the separation roller positioned at a contact position and the peripheral configuration thereof.

Next, a peripheral configuration of the separation roller 116 and a separation operation with respect to the conveyance roller 115 will be described. As illustrated in FIGS. 7 to 8B, the separation roller 116 is retained rotatably by a separation roller holder 132. The separation roller 116 includes a torque limiter that is driven to rotate by the sheet when a predetermined torque is applied, and the separation roller 116 is retained in the separation roller holder 132 via the torque limiter.

A holder shaft 132*b* is rotatably supported on the conveyance guide 135, and the holder shaft 132*b* supports the separation roller holder 132 such that the separation roller holder 132 pivots integrally with the holder shaft 132*b*. The separation roller holder 132 is pivotable to a separation position, that is, the position illustrated in FIG. 8A, where the separation roller 116 is separated from the conveyance roller 115, and a contact position, that is, the position illustrated in FIG. 8*b*, where the separation roller 116 contacts the conveyance roller 115. The separation roller holder 132 is urged to the contact position by a separation spring 133.

Further, a separation nip guide 134 is fixed to the conveyance guide 135, and the separation nip guide 134 includes an inclined plane 134*a* that is formed approximately flush with the inclined plane 135*a* of the conveyance guide 135. The inclined plane 134*a* guides the sheet S fed by the feeding roller 104 (refer to FIG. 1) smoothly toward the separation nip 117.

Meanwhile, as illustrated in FIG. 3A and FIGS. 7 to 8B, a separation cam 136 that rotates integrally with the separation gear 124 is mounted to the separation gear 124. A lever portion 132*a* is fixed to one end portion of the holder shaft 132*b*, and the lever portion 132*a* is capable of being in contact with a cam surface 136*a* of the separation cam 136.

In a state where the separation roller 116 is positioned at the separation position, the lever portion 132*a* contacts the cam surface 136*a* of the separation cam 136. The separation spring 133 urges the holder shaft 132*b* in a clockwise direction of FIG. 8A via the separation roller holder 132. That is, in a state where the separation roller 116 is positioned at the separation position, the lever portion 132*a* is pressed against the cam surface 136*a* by the urging force of the separation spring 133.

In a state where the chipped tooth gear 123 and the separation gear 124 rotate and the separation cam 136 is rotated therewith, the engagement between the cam surface 136*a* of the separation cam 136 and the lever portion 132*a* is cancelled, and the separation roller holder 132 pivots upward around the holder shaft 132*b* by the separation spring 133. Thereby, the separation roller 116 retained by the separation roller holder 132 contacts the conveyance roller 115 and the separation roller 116 is positioned at the contact position.

When the separation cam 136 rotates further, the lever portion 132*a* is reengaged with the cam surface 136*a*, and the separation roller 116 pivots to the separation position. In a state where the separation roller 116 is positioned at the separation position, the chipped tooth gear 123 is stopped at the standby position by the solenoid unit 65. That is, in a state where the chipped tooth gear 123 and the separation cam 136 rotate once, the separation roller 116 swings from the separation position to the contact position and then again to the separation position.

Operation of Return Claw

Figure 9A:
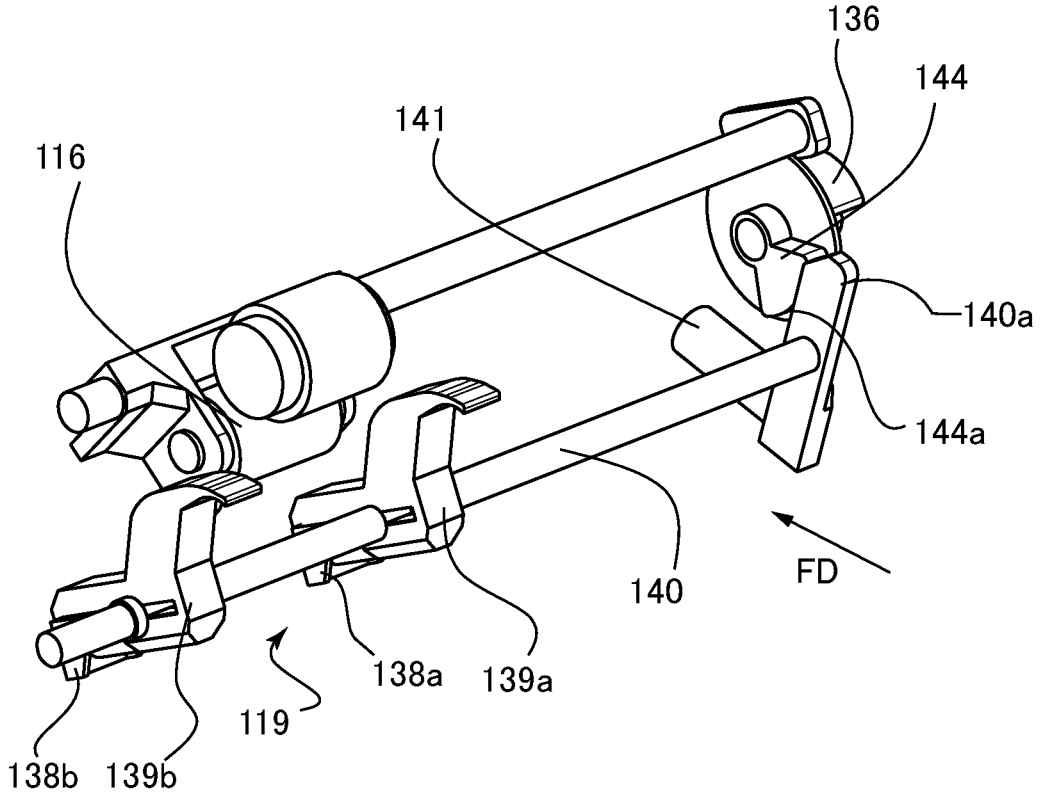
FIG. 9A is a perspective view illustrating a return claw positioned at a standby position.

Next, the configuration and operation of the return claw 119 will be described. FIG. 9A is a perspective view illustrating the return claw 119 positioned at the standby position serving as a protruded position, and FIG. 9B is a perspective view illustrating the return claw 119 positioned at a retreated position.

Figure 9B:
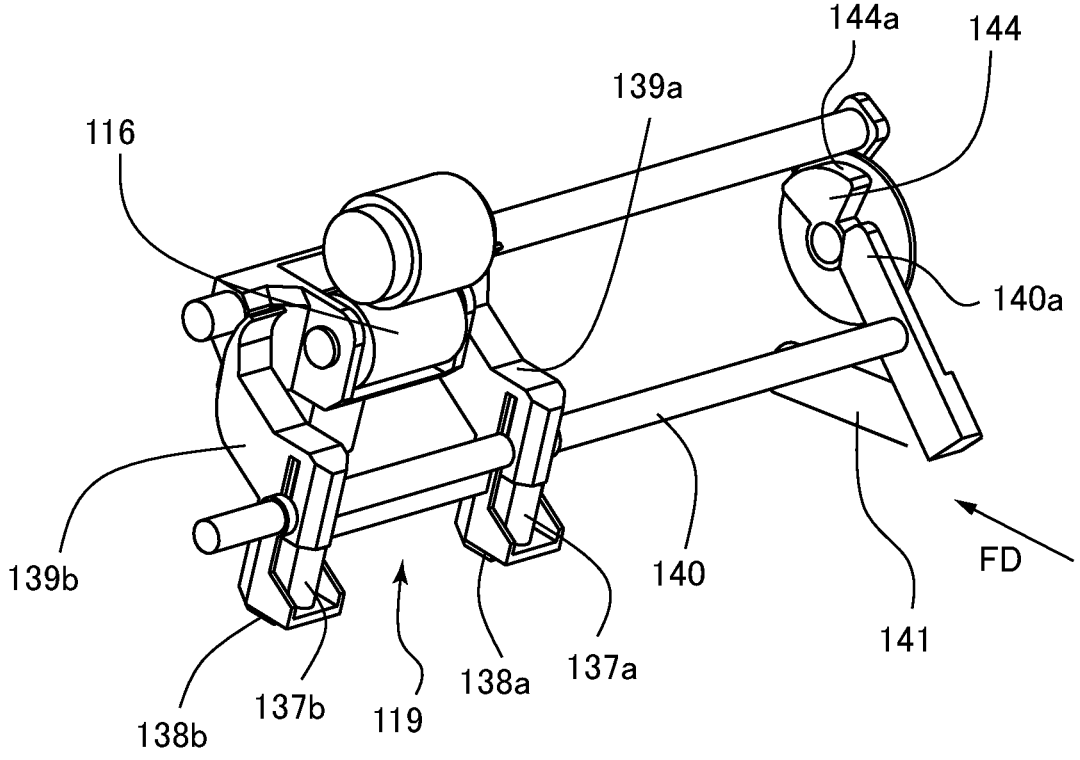
FIG. 9B is a perspective view illustrating the return claw positioned at a retreated position.

As illustrated in FIGS. 9A and 9B, the return claw 119 includes a pivot shaft 140 serving as a first pivot shaft that is supported pivotably on the conveyance guide 135 (refer to FIG. 7), base units 138*a* and 138*b* that are fixed to the pivot shaft 140, and claw portions 139*a* and 139*b*. The base unit 138*b* and the claw portion 139*b* are arranged at a predetermined distance from the base unit 138*a* and the claw portion 139*a* in the axial direction of the pivot shaft 140, and they adopt the same configuration as the base unit 138*a* and the claw portion 139*a*.

The positions of the claw portions 139*a* and 139*b* are determined with respect to the pivot shaft 140 in the axial direction, and the claw portions 139*a* and 139*b* are supported movably in the radial direction orthogonal to the axial direction. A spring 137*a* is disposed in a compressed manner between the base unit 138*a* and the claw portion 139*a*, and the spring 137*a* urges the claw portion 139*a* outward in the radial direction with respect to the pivot shaft 140. Similarly, a spring 137*b* is disposed in a compressed manner between the base unit 138*b* and the claw portion 139*b*, and the spring 137*b* urges the claw portion 139*b* outward in the radial direction with respect to the pivot shaft 140.

Meanwhile, as illustrated in FIGS. 3A, 9A and 9B, a return claw cam 144 that rotates integrally with the separation gear 124 is attached to the separation gear 124. A cam follower 140*a* is provided on one end portion of the pivot shaft 140, and the cam follower 140*a* serving as a first cam follower is arranged in a manner capable of being in contact with a cam surface 144*a* of the return claw cam 144 serving as a first cam. The return claw 119 is urged in a counterclockwise direction of FIGS. 9A and 9B around the pivot shaft 140 by a return claw spring 141.

As illustrated in FIG. 9A, in a state where the return claw 119 is positioned at the standby position, the cam follower 140*a* is in contact with the cam surface 144*a* of the return claw cam 144. The cam follower 140*a* is pressed against the cam surface 144*a* by the urging force of the return claw spring 141.

In a state where the chipped tooth gear 123 and the separation gear 124 rotate and the return claw cam 144 is rotated therewith, the engagement between the cam surface 144*a* of the return claw cam 144 and the cam follower 140*a* is cancelled, and the return claw 119 pivots in the counterclockwise direction around the pivot shaft 140 by the return claw spring 141. Thereby, the return claw 119 moves to the retreated position. That is, the return claw 119 pivots downstream in the sheet feeding direction FD by moving from the standby position to the retreated position, where it is retreated from the conveyance path through which the sheet S passes.

More specifically, in the retreated position, the return claw 119 is retreated in an opposite direction from the feeding roller 104 with respect to the inclined plane 135*a* of the conveyance guide 135. Thereby, the sheet S conveyed by the feeding roller 104 and the separation nip 117 is conveyed smoothly without being obstructed by the return claw 119 positioned at the retreated position.

When the return claw cam 144 rotates further, the cam follower 140*a* is reengaged with the cam surface 144*a*, and the return claw 119 swings to the standby position. In a state where the return claw 119 is positioned at the standby position, the chipped tooth gear 123 is stopped at the standby position by the solenoid unit 65. That is, in a state where the chipped tooth gear 123 and the separation cam 136 rotate once, the return claw 119 pivots from the standby position to the retreated position and then again to the standby position.

Next, the operation of the return claw 119 during conveyance of a sheet will be described with reference to FIGS. 10A to 10C. In the following description, an uppermost sheet supported on the supporting tray 110 is referred to as a first sheet S1, and the sheet superposed with the first sheet S1 in the stacking direction SD is referred to as a second sheet S2.

Figure 10A:
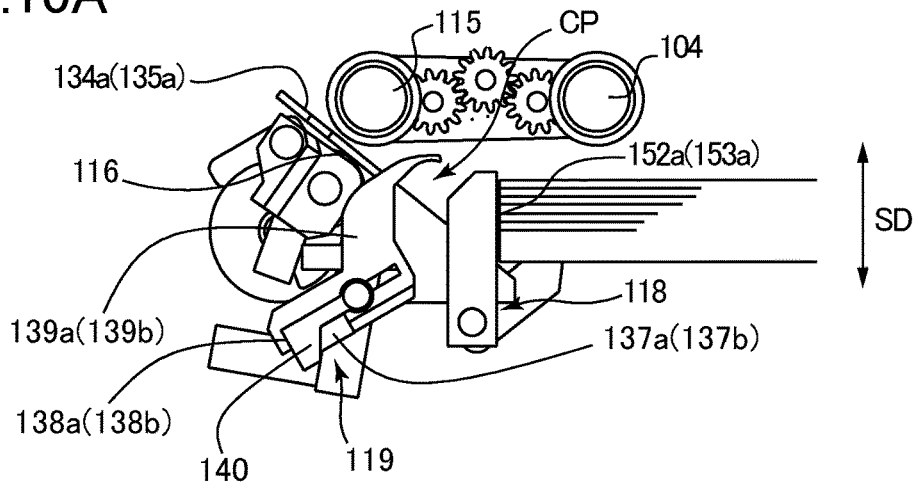
FIG. 10A is a cross-sectional view illustrating a state of the return claw prior to feeding of the sheet.

As illustrated in FIG. 10A, in a state where an image forming job is not entered and the chipped tooth gear 123 is stopped at the standby position, the return claw 119 is positioned at the standby position. The claw portions 139*a* and 139*b* are protruded into a conveyance path CP in a state where the return claw 119 is positioned at the standby position. In this state, the separation roller 116 is positioned at the separation position.

Figure 10B:
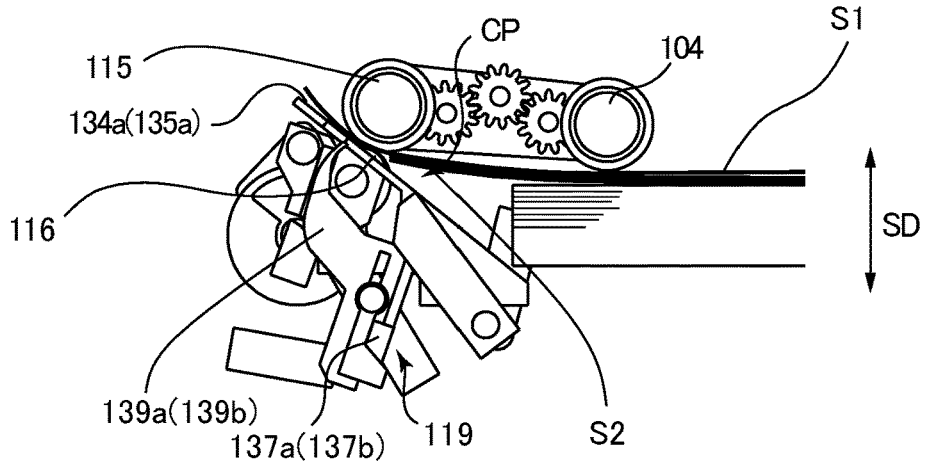
FIG. 10B is a perspective view illustrating a state of the return claw during conveyance of the sheet.

FIG. 10B is a cross-sectional view illustrating a state where the sheet is being conveyed. In this state, the separation roller 116 is positioned at the contact position, and the return claw 119 is positioned at the retreated position so as not to obstruct conveyance of the first sheet S1. In a state where the return claw 119 is positioned at the retreated position, the claw portions 139*a* and 139*b* are retreated from the conveyance path CP through which the sheet passes. The separation nip 117 formed by the conveyance roller 115 and the separation roller 116 convey the first sheet S1. The second sheet S2 is fed by following the first sheet S1 fed by the feeding roller 104, but it is separated from the first sheet S1 by the separation nip 117 serving as a separation portion.

Figure 10C:
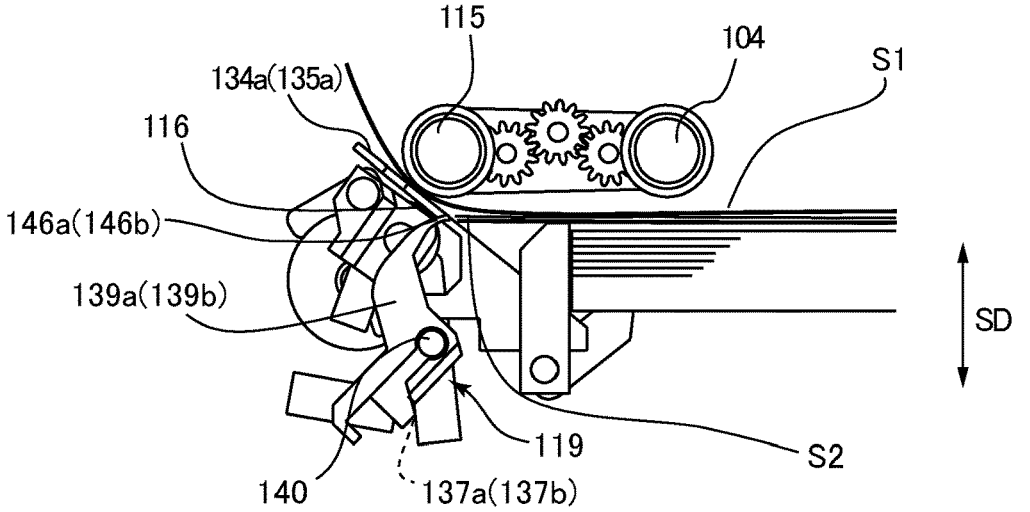
FIG. 10C is a cross-sectional view illustrating a state of the return claw returning a second sheet.

FIG. 10C is a cross-sectional view illustrating a state in which the return claw 119 is returning the second sheet S2 toward the supporting tray 110 (refer to FIG. 1). In this state, the separation roller 116 is positioned at the separation position. As described, the return claw 119 pivots from the retreated position to the standby position by rotation of the return claw cam 144, and leading edge portions 146*a* and 146*b* of the claw portions 139*a* and 139*b* of the return claw 119 slide against a lower surface of the first sheet S1. Thereby, the second sheet S2 separated from the first sheet S1 by the separation nip 117 is returned toward the supporting tray 110.

When the return claw 119 pivots from the retreated position to the standby position, the claw portions 139*a* and 139*b* receive force toward the inner side in the radial direction of the pivot shaft 140 from the first sheet S1. Therefore, the claw portions 139*a* and 139*b* move so as to compress the springs 137*a* and 137*b*. While the first sheet S1 passes the leading edge portions 146*a* and 146*b* of the claw portions 139*a* and 139*b*, the leading edge portions 146*a* and 146*b* slide against the surface of the first sheet S1 and the position of the claw portions 139*a* and 139*b* is maintained.

When the trailing edge of the first sheet S1 passes the leading edge portions 146*a* and 146*b* of the claw portions 139*a* and 139*b*, the claw portions 139*a* and 139*b* are returned by the springs 137*a* and 137*b* to the position illustrated in FIG. 10A. According to this configuration, through-put is improved since the return claw 119 swiftly returns to the standby position illustrated in FIG. 10A after the trailing edge of the first sheet S1 passes the leading edge portions 146*a* and 146*b* of the claw portions 139*a* and 139*b*.

Operation of Leading Edge Regulation Portion

Figure 11A:
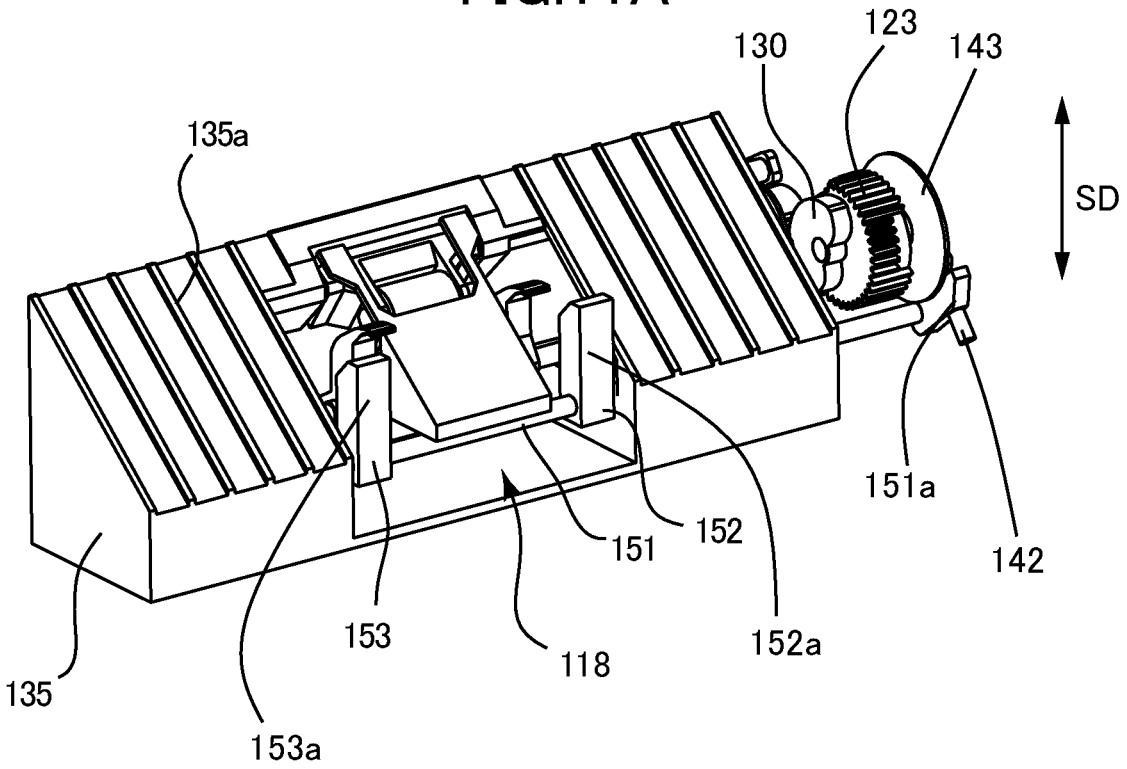
FIG. 11A is a perspective view illustrating a leading edge regulating portion positioned at a standby position.
Figure 11B:
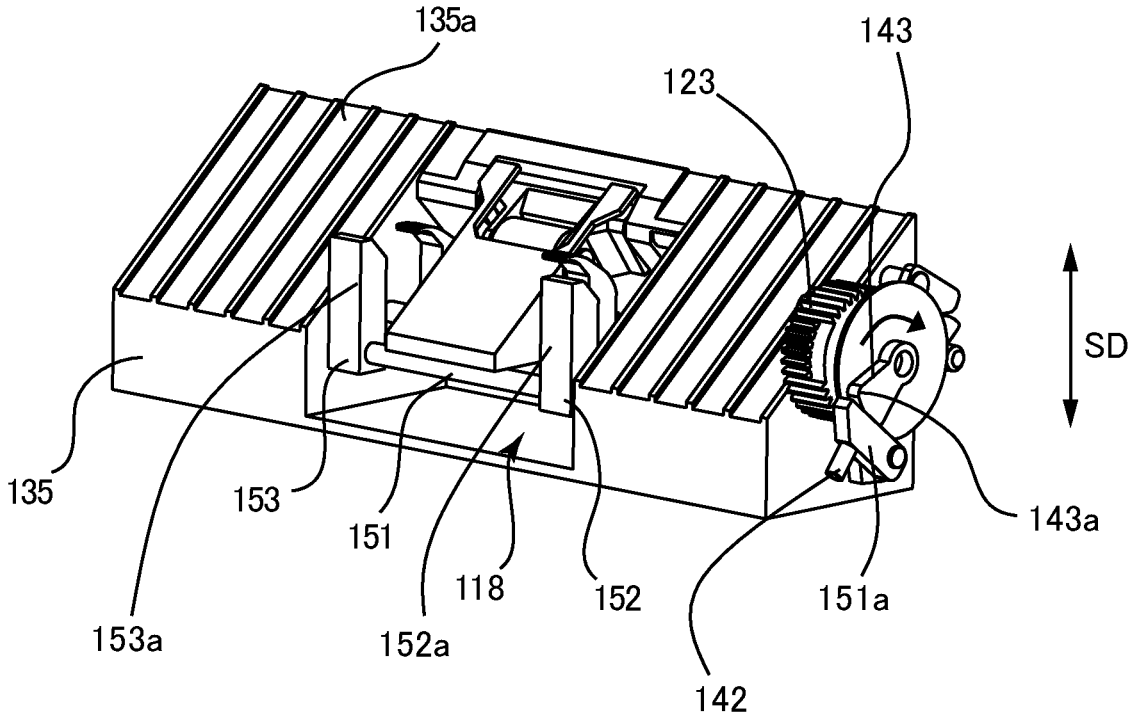
FIG. 11B is a perspective view illustrating a leading edge regulating portion positioned at the standby position.

Next, the configuration and operation of the leading edge regulating portion 118 will be described. FIGS. 11A and 11B are perspective views illustrating the leading edge regulating portion 118 positioned at the standby position serving as a regulating position. As illustrated in FIGS. 11A and 11B, the leading edge regulating portion 118 serving as a regulating portion includes a pivot shaft 151 serving as a second pivot shaft supported pivotably by the conveyance guide 135, and leading edge regulating members 152 and 153 fixed to the pivot shaft 151. The pivot shaft 151 extends in parallel to the pivot shaft 140 (refer to FIG. 9A). The leading edge regulating member 153 is arranged at a predetermined distance from the leading edge regulating member 152 in the axial direction of the pivot shaft 140, and it adopts the same configuration as the leading edge regulating member 152. In the present embodiment, the leading edge regulating members 152 and 153 can be respectively arranged such that at least a portion of the leading edge regulating members 152 and 153 is overlapped with the claw portions 139*a* and 139*b* in an axial direction AD of the pivot shaft 151, or they may be arranged so as to offset from the claw portions 139*a* and 139*b*.

The leading edge regulating members 152 and 153 serving as regulating members respectively include regulating surfaces 152*a* and 153*a* that extend in the stacking direction SD and regulate the leading edge position of the sheet S supported on the supporting tray 110 (refer to FIG. 1) in a state where the leading edge regulating portion 118 is positioned at the standby position. As illustrated in FIG. 10A, in a state where the leading edge regulating portion 118 is positioned at the standby position, the regulating surfaces 152*a* and 153*a* protrude in the stacking direction SD from the inclined planes 134*a* 135*a* when viewed in the axial direction of the feeding roller 104.

Meanwhile, as illustrated in FIGS. 3B, 11A and 11B, a leading edge regulating cam 143 that rotates integrally with the chipped tooth gear 123 is attached to the chipped tooth gear 123. The leading edge regulating cam 143 serving as a second cam is arranged on an opposite side as the feeding cam 130 interposing the chipped tooth gear 123. A cam follower 151*a* is provided on one end portion of the pivot shaft 151, and the cam follower 151*a* serving as a second cam follower is provided in a manner capable of being in contact with a cam surface 143*a* of the leading edge regulating cam 143. The leading edge regulating portion 118 is urged to rotate clockwise in the view of FIG. 11B around the pivot shaft 151 by a leading edge regulating spring 142.

As illustrated in FIG. 11B, the cam follower 151*a* is in contact with the cam surface 143*a* of the leading edge regulating cam 143 in a state where the leading edge regulating portion 118 is positioned at the standby position. The cam follower 151*a* is pressed against the cam surface 143*a* by urging force of the leading edge regulating spring 142.

Figure 12A:
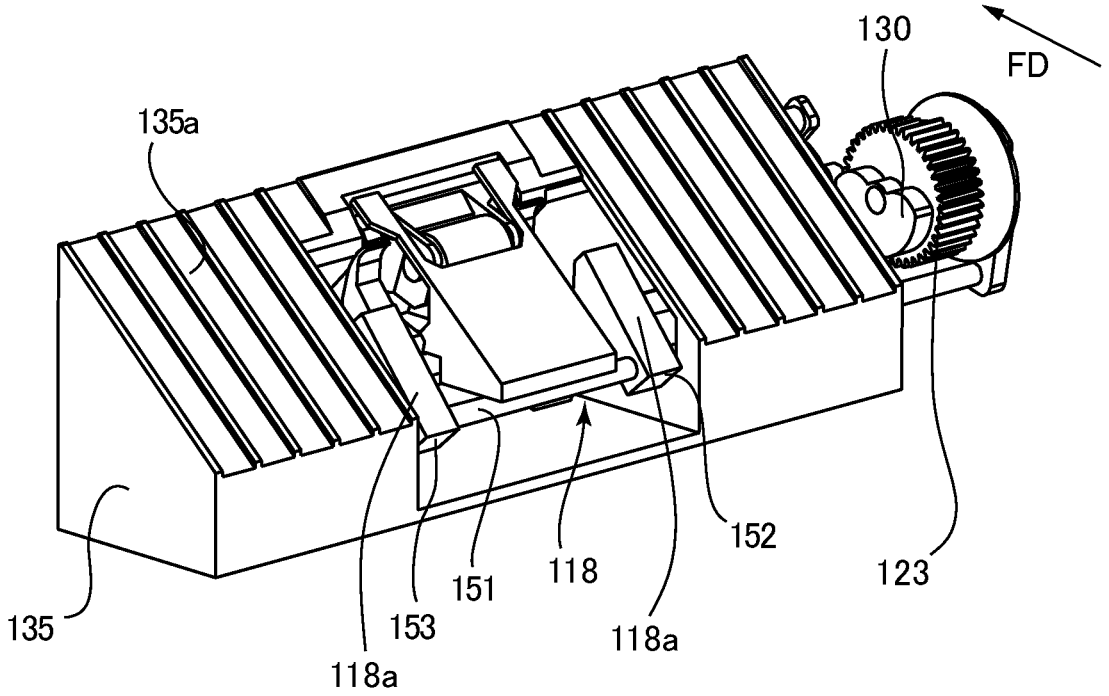
FIG. 12A is a perspective view illustrating the leading edge regulating portion positioned at a retreated position.
Figure 12B:
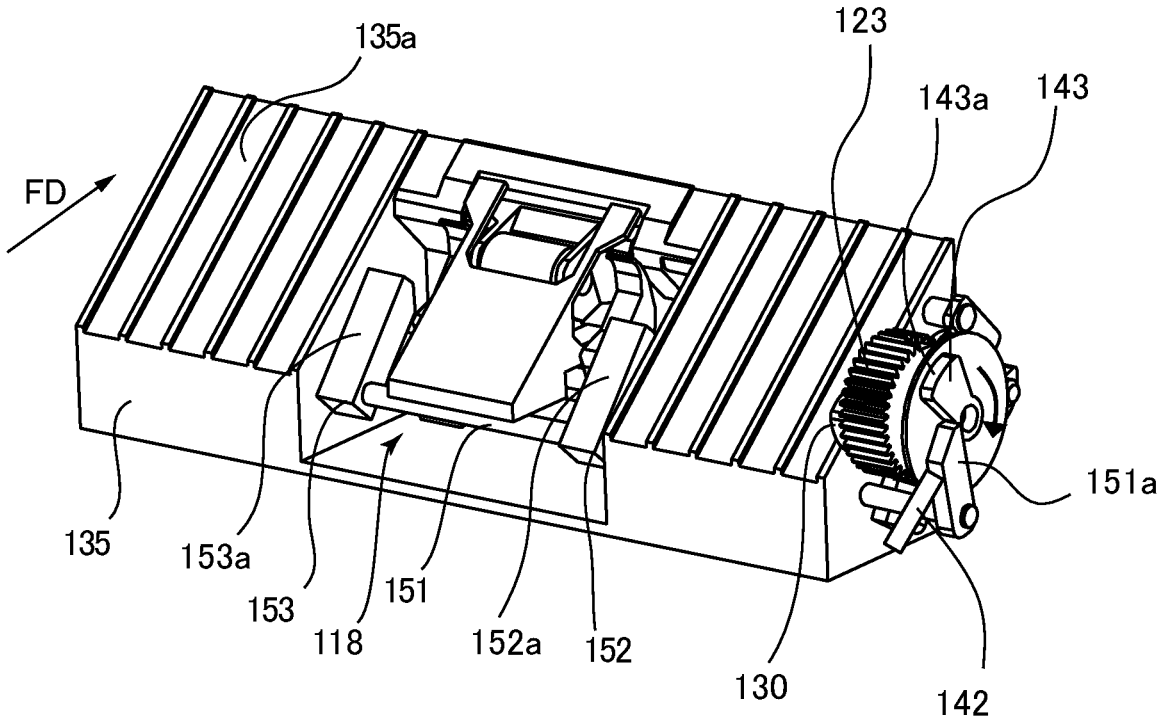
FIG. 12B is a perspective view illustrating the leading edge regulating portion positioned at the retreated position.

In a state where the chipped tooth gear 123 rotates and the leading edge regulating cam 143 rotates therewith, as illustrate in FIGS. 12A and 12B, the engagement between the cam surface 143*a* of the leading edge regulating cam 143 and the cam follower 151*a* is cancelled. Then, the leading edge regulating portion 118 pivots in the arrow direction in FIG. 12B around the pivot shaft 151 by the leading edge regulating spring 142. Thereby, the leading edge regulating portion 118 moves to a retreated position serving as an allowing position. That is, the leading edge regulating portion 118 pivots downstream in the sheet feeding direction FD by moving from the standby position to the retreated position, and allows the sheet S to be conveyed.

More specifically, the retreated position is a position of the leading edge regulating portion 118 where the regulating surfaces 152*a* and 153*a* are aligned against the inclined plane 135*a* of the conveyance guide 135. In a state where the leading edge regulating portion 118 is positioned at the retreated position, the regulating surfaces 152*a* and 153*a* may either be retreated as a whole toward the inner side of the conveyance guide 135 with respect to the inclined plane 135*a* or be slightly protruded toward the feeding roller 104. In any case, the leading edge regulating portion 118 is positioned at the retreated position to allow the conveyance of the sheet S.

When the leading edge regulating cam 143 rotates further, the cam follower 151*a* is reengaged with the cam surface 143*a*, and the leading edge regulating portion 118 pivots to the standby position. In a state where the leading edge regulating portion 118 is positioned at the standby position, the chipped tooth gear 123 stops at the standby position by the solenoid unit 65. That is, in a state where the chipped tooth gear 123 rotates once, the leading edge regulating portion 118 pivots from the standby position to the retreated position and then again to the standby position.

Operation Timing of Return Claw and Leading Edge Regulating Portion

Next, an operation timing of the return claw 119 and the leading edge regulating portion 118 will be described. For example, if a certain amount of sheets S is conveyed by the feeding roller 104 in a state where the return claw 119 is positioned at the standby position, the sheet S may be scraped against the leading edge portions 146*a* and 146*b* of the return claw 119, which may cause the sheet S to be damaged.

Therefore, the timing at which the return claw 119 pivots from the standby position to the retreated position will be set as follows. An ideal conveyance distance of the sheet S by the feeding roller 104 when there is no slippage between the sheet S and the feeding roller 104 immediately after starting of conveyance operation is referred to as distance A. A distance from the regulating surfaces 152*a* and 153*a* of the leading edge regulating portion 118 positioned at the standby position to the leading edge portions 146*a* and 146*b* of the return claw 119 positioned at the standby position is referred to as distance B.

According to the present embodiment, in a case where distance A<distance B, the energization timing of the solenoid 68 is controlled so that the return claw 119 pivots from the standby position to the retreated position. Thereby damages to the sheet S can be reduced.

Further, the leading edge regulating portion 118 pivots from the standby position to the retreated position before the feeding roller 104 contacts the sheet S on the supporting tray 110. Even further, if the distance from the regulating surfaces 152*a* and 153*a* of the leading edge regulating portion 118 positioned at the standby position to the separation nip 117 is referred to as distance C, in a case where distance A<distance C, the separation roller 116 moves from the separation position to the contact position.

Moreover, if the distance from the regulating surfaces 152*a* and 153*a* of the leading edge regulating portion 118 positioned at the standby position to the nip of the conveyance roller pair 105 is referred to as distance D, in a case where distance A>distance D, the separation roller 116 moves from the contact position to the separation position. After the separation nip 117 has been cancelled, the return claw 119 and the leading edge regulating portion 118 return from the retreated position to the standby position. The operation timings of the return claw 119 and the leading edge regulating portion 118 are not necessarily the same, and they can be set differently.

The timings at which the return claw 119, the leading edge regulating portion 118 and the separation roller 116 are operated and the lifting and lowering of the feeding roller 104 are determined by the energization timing of the solenoid 68 and the shapes of the return claw cam 144, the leading edge regulating cam 143, the separation cam 136 and the feeding cam 130. The operation timings can be set arbitrarily.

Comparative Example

Figure 16:
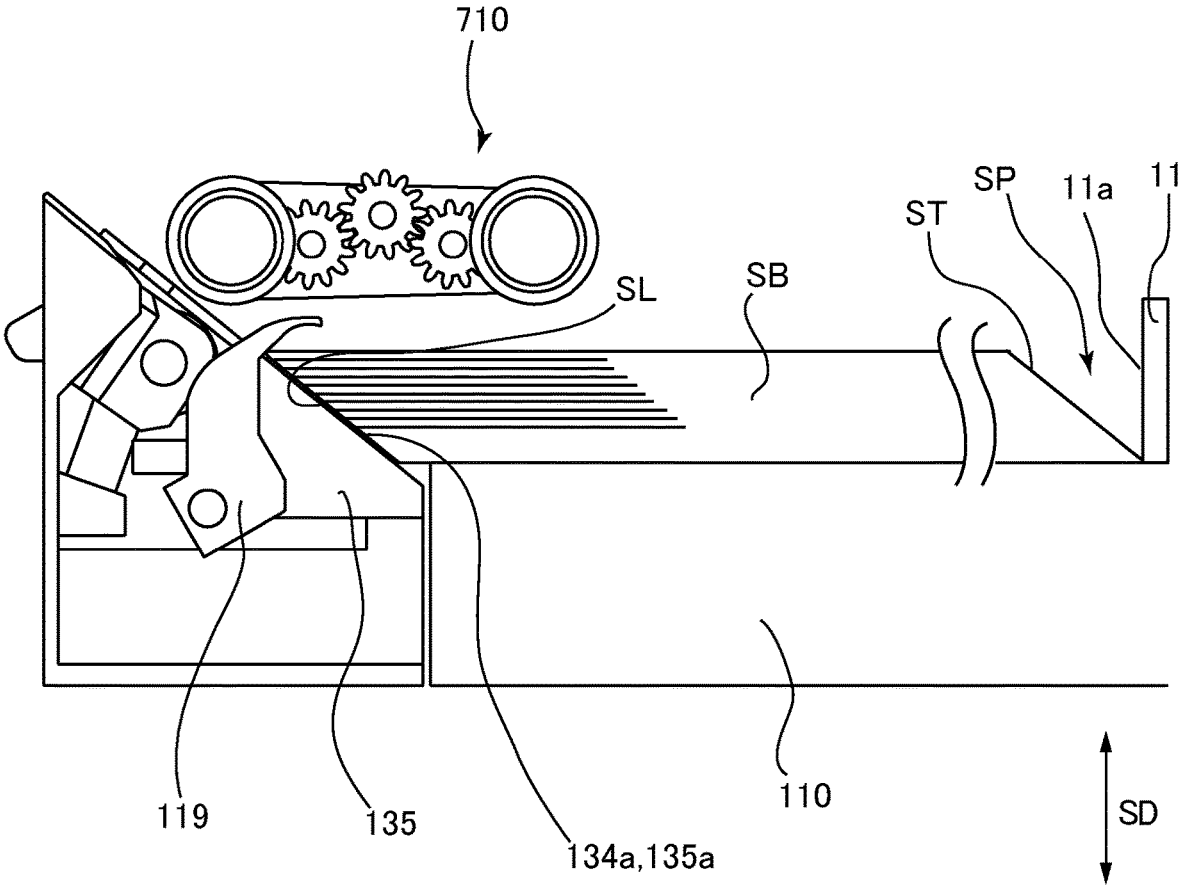
FIG. 16 is a cross-sectional view illustrating a sheet feeding apparatus according to a comparative example.

FIG. 16 is a cross-sectional view illustrating a sheet feeding apparatus 710 according to a comparative example. The sheet feeding apparatus 710 does not include the leading edge regulating portion 118, and leading edges SL of a sheet bundle SB set on the supporting tray 110 are aligned against inclined planes 134*a* and 135*a*. The inclined planes 134*a* and 135*a* extend in a direction inclined toward the sheet feeding direction FD and the stacking direction SD, so that the leading edges SL of the sheet bundle SB are dispersed in the sheet feeding direction FD. As described, there is a problem in the setting property of the sheet bundle SB.

The trailing edge regulating plate 11 includes a regulating surface 11*a* that is extended in the stacking direction SD and that regulates the position of trailing edges ST of the sheet bundle SB. As described above, in a state where the leading edges SL of the sheet bundle SB are aligned against the inclined planes 134*a* and 135*a*, the trailing edges ST of the sheet bundle SB are also dispersed in the sheet feeding direction FD. Then, a space SP is formed between the trailing edge ST of the sheet bundle SB and the regulating surface 11*a* extending in the stacking direction SD, and the sheet bundle SB tends to be deviated. Therefore, the position of the leading edges of the sheet become unstable, and the feeding performance is deteriorated.

Effect of Present Embodiment

Thus, the sheet feeding apparatus 10 of the present embodiment is provided with the leading edge regulating portion 118. The leading edge regulating portion 118 includes regulating surfaces 152*a* and 152*b* that extend in the stacking direction SD at the standby position. The sheets S supported on the supporting tray 110 are set in a state where the leading edges of the sheets are abutted against the regulating surfaces 152*a* and 152*b*, so that the setting property of sheets can be improved.

Further, the sheet feeding apparatus 10 includes the return claw 119, and the return claw 119 returns the sheet retained at the separation nip 117 toward the supporting tray 110. Thereby, multiple feeding of the sheets S can be reduced and the feeding performance can be improved. As described, improvement of both the feeding performance and the setting performance of the sheets S are realized.

Second Embodiment

Next, a second embodiment of the present invention will be described. The configuration of the leading edge regulating portion 118 of the first embodiment has been changed according to the second embodiment. Similar configurations as the first embodiment are either not shown or denoted with the same reference numbers in the drawings.

Figure 13:
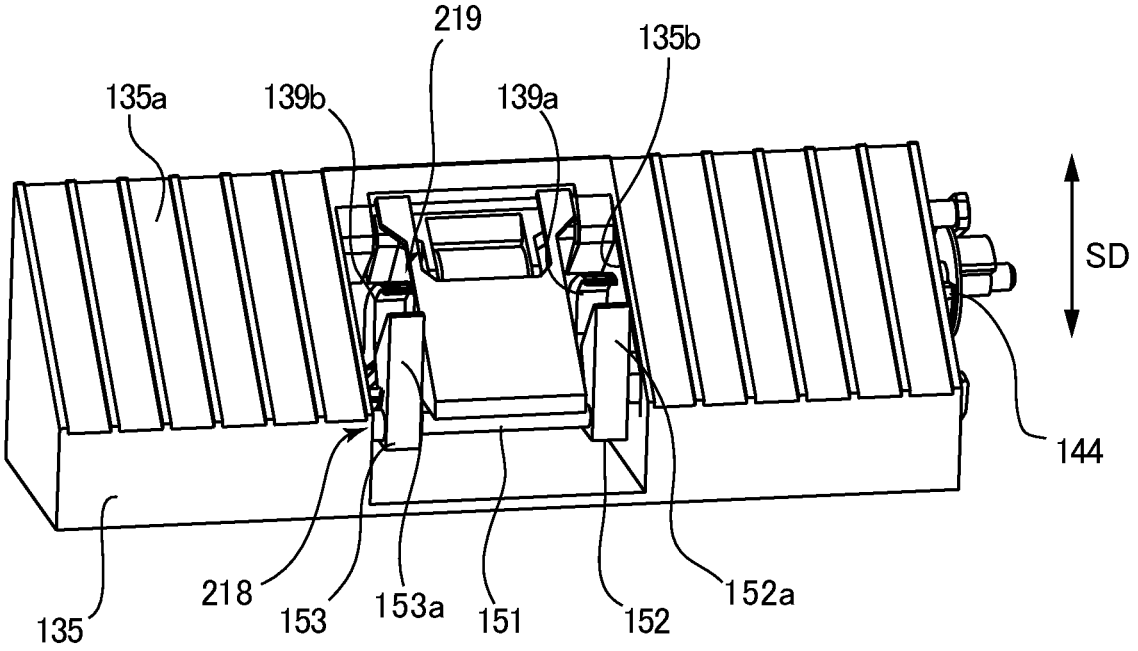
FIG. 13 is a perspective view illustrating a leading edge regulating portion according to a second embodiment.

As illustrated in FIG. 13, a leading edge regulating portion 218 according to a second embodiment includes a pivot shaft 151 supported pivotably on the conveyance guide 135 and leading edge regulating members 152 and 153 fixed to the pivot shaft 151. The leading edge regulating members 152 and 153 respectively include regulating surfaces 152*a* and 153*a* that extend in the stacking direction SD and regulate the position of the leading edge of the sheet S supported on the supporting tray 110 (refer to FIG. 1) in a state where the leading edge regulating portion 218 is positioned at the standby position.

Meanwhile, the leading edge regulating portion 218 does not include a cam follower 151*a* (refer to FIG. 11B) as according to the first embodiment, and a leading edge regulating cam 143 as illustrated in FIG. 3B is also omitted.

Figure 14A:
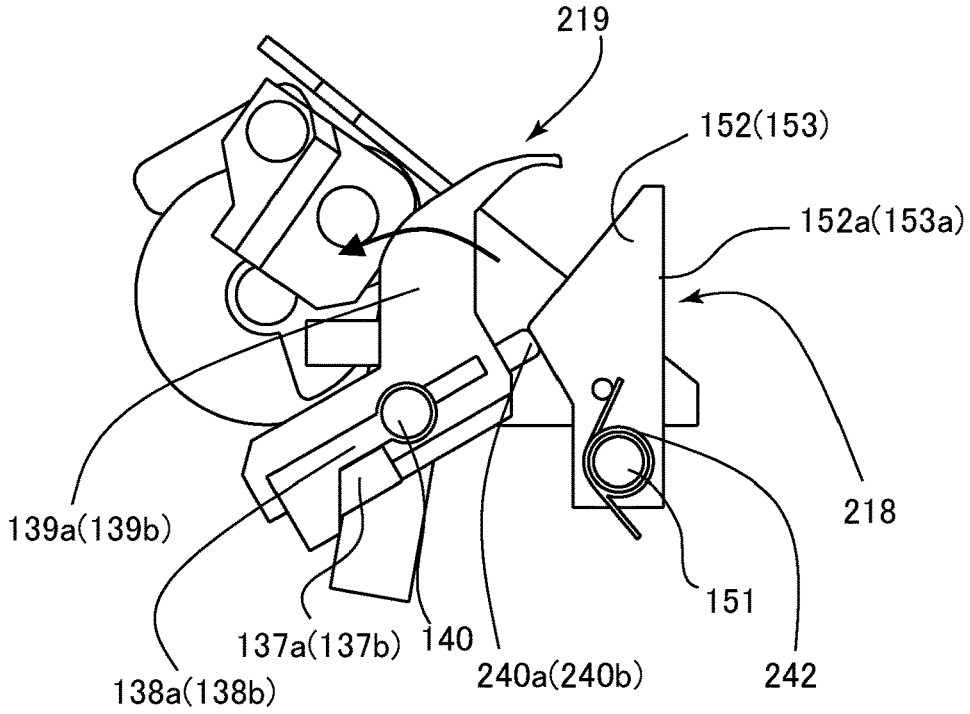
FIG. 14A is a cross-sectional view illustrating a state of the leading edge regulating portion and a return claw positioned at a standby position.
Figure 14B:
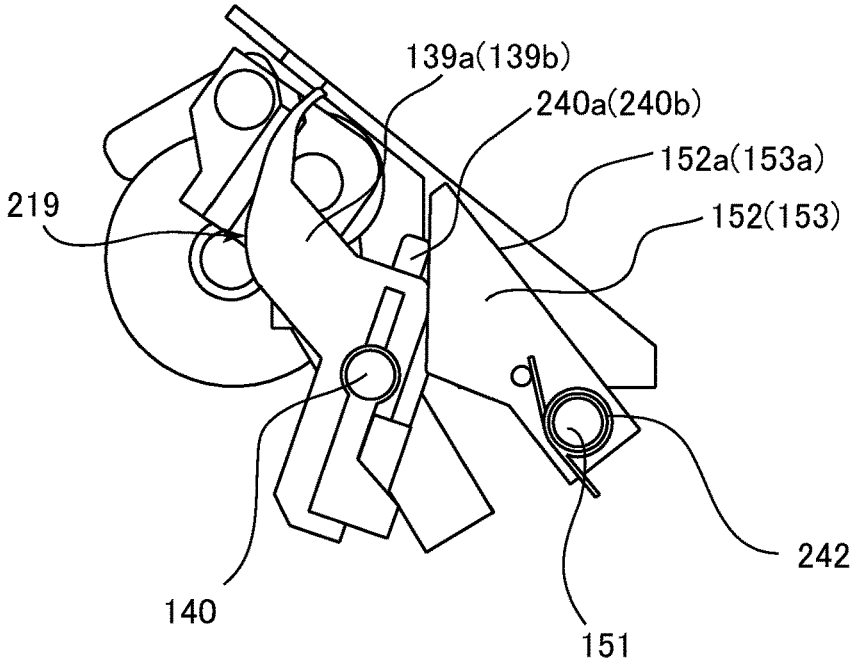
FIG. 14B is a cross-sectional view illustrating a state of the leading edge regulating portion and the return claw positioned at a retreated position.

FIG. 14A is a cross-sectional view illustrating a state where a return claw 219 and the leading edge regulating portion 218 are positioned at the standby position, and FIG. 14B is a cross-sectional view illustrating a state where the return claw 219 and the leading edge regulating portion 218 are positioned at the retreated position.

As illustrated in FIGS. 13 and 14A, the return claw 219 serving as a return portion includes a pivot shaft 140 supported pivotably on the conveyance guide 135, base units 138*a* and 138*b* fixed to the pivot shaft 140, and claw portions 139*a* and 139*b*.

The claw portions 139*a* and 139*b* are positioned in the axial direction with respect to the pivot shaft 140 and supported movably in the radial direction orthogonal to the axial direction. A spring 137*a* is disposed in a compressed manner between the base unit 138*a* and the claw portion 139*a*, and the spring 137*a* urges the claw portion 139*a* outward in the radial direction with respect to the pivot shaft 140. Similarly, a spring 137*b* is disposed in a compressed manner between the base unit 138*b* and the claw portion 139*b*, and the spring 137*b* urges the claw portion 139*b* outward in the radial direction with respect to the pivot shaft 140. The drive configuration of the return claw 219 is similar to that of the first embodiment.

The leading edge regulating members 152 and 153 are respectively arranged such that at least a portion thereof overlaps with the claw portions 139*a* and 139*b* in an axial direction AD of the pivot shaft 151. The claw portions 139*a* and 139*b* are respectively provided with contact portions 240*a* and 240*b* that come into contact with the leading edge regulating members 152 and 153. The leading edge regulating members 152 and 153 are urged by a leading edge regulating spring 242 serving as an urging portion attached to the pivot shaft 151 so as to contact the contact portions 240*a* and 240*b*.

That is, in a state where the return claw 219 is positioned at the standby position, the contact portions 240*a* and 240*b* regulate pivoting of the leading edge regulating portion 218 to the retreated position. Further, the leading edge regulating portion 218 serving as a regulating portion is allowed to pivot from the standby position to the retreated position by the return claw 219 pivoting from the standby position to the retreated position.

As illustrated in FIGS. 14A and 14B, in a state where the return claw 219 pivots from the standby position to the retreated position, the leading edge regulating portion 218 pivots by the urging force of the leading edge regulating spring 242 in a direction following the contact portions 240*a* and 240*b* of the return claw 219. Thereby, the leading edge regulating portion 218 pivots from the standby position to the retreated position.

When the return claw 219 pivots from the retreated position to the standby position, the leading edge regulating portion 218 is pressed by the contact portions 240*a* and 240*b* against the urging force of the leading edge regulating spring 242. Thereby, the leading edge regulating portion 218 is returned to the standby position.

In the present embodiment, the leading edge regulating portion 218 is urged downstream in the sheet feeding direction FD by the leading edge regulating spring 242, but the present invention is not limited thereto. For example, a configuration without the leading edge regulating spring 242 can be adopted where the leading edge regulating portion 218 is pressed and pivoted by the leading edge of the sheet S conveyed by the feeding roller 104.

Effects of the Embodiment

According to the above-described configuration, the sheets S supported on the supporting tray 110 can be set in a state where the leading edges of the sheets S are abutted against the regulating surfaces 152*a* and 152*b*, so that the setting property can be improved. Further, the return claw 219 returns the sheet retained at the separation nip 117 toward the supporting tray 110. Thereby, multiple feeding of sheets S can be reduced and the feeding performance can be improved. As described, improvement of both the feeding performance and the setting performance of the sheets S is realized.

The leading edge regulating members 152 and 153 of the leading edge regulating portion 218 are respectively arranged such that at least a portion of the leading edge regulating members 152 and 153 is overlapped with the claw portions 139*a* and 139*b* in the axial direction AD. Therefore, a recessed portion 135*b* (refer to FIG. 13) of the conveyance guide 135 where the leading edge regulating members 152 and 153 and the claw portions 139*a* and 139*b* are stored can be downsized. Thus, occurrence of conveyance failures caused by the sheet S being caught in the recessed portion 135*b* can be reduced.

Other Embodiments

Figure 15:
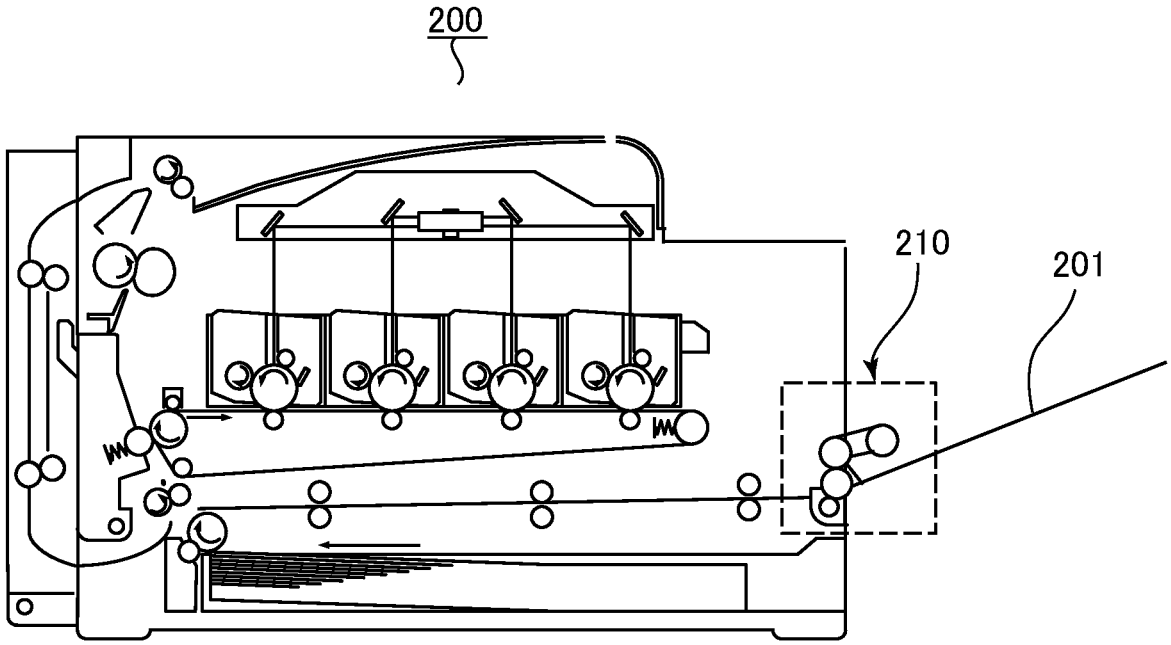
FIG. 15 is an entire schematic diagram illustrating a printer according to another embodiment.

All the embodiments described above have been described based on the sheet feeding apparatus 10 that feeds sheets supported on the supporting tray 110, but the present invention is not limited thereto. For example, as illustrated in FIG. 15, a printer 200 serving as an image forming apparatus includes a manual feed tray 201 and a sheet feeding apparatus 210 that conveys sheets supported on the manual feed tray 201. The present invention is applicable to the sheet feeding apparatus 210. Further, the present invention is also applicable to an ADF, that is, Auto Document Feeder, provided on the image reading apparatus.

In all the embodiments described above, the sheet S is fed by the feeding roller 104, but the present invention is not limited thereto. For example, a belt that attracts the sheets S by electrostatic force of negative pressure can be used instead of the feeding roller 104 to feed the sheets S.

Further, in all the embodiments described above, the sheets S are set on the supporting tray 110, but the present invention is not limited thereto. For example, the supporting tray 110 can be detachably mounted to the printer body, or the supporting tray 110 can be replaced with a cassette that is detachably mounted to the printer body to store sheets.

In the second embodiment, the contact portions 240*a* and 240*b* are provided on the claw portions 139*a* and 139*b*, but the present invention is not limited thereto. For example, the contact portions 240*a* and 240*b* can be provided on the pivot shaft 140 of the return claw 219.

All the embodiments have been described based on the printer 100 or 200 adopting the electrophotographic system, but the present invention is not limited thereto. For example, the present invention is applicable to an image forming apparatus that adopts an ink-jet system in which image is formed on sheets by discharging ink through nozzles.

Other Embodiments

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-231458, filed Dec. 23, 2019, which is hereby incorporated by reference herein in its entirety.

What is claimed is:

1. A sheet feeding apparatus comprising:

a sheet support configured to support a first sheet and a second sheet that are superposed in a stacking direction;

a rotary feeder configured to feed the first sheet supported on the sheet support;

a separator configured to separate the second sheet fed by following the first sheet from the first sheet;

a return configured to return the second sheet, separated by the separator from the first sheet, toward the sheet support;

a regulator comprising a regulating surface configured to regulate a position of leading edges of the first sheet and the second sheet supported on the sheet support, the regulator being configured to move between a regulating position in which the regulating surface regulates the position of leading edges of the first sheet and the second sheet, and an allowing position in which the regulator allows feeding of the first sheet and the second sheet supported on the sheet support, the regulating surface being extended in the stacking direction in a state where the regulator is positioned at the regulating position;

a driver configured to generate driving force; and a drive transmission configured to drive the return and the regulator by the driving force of the driver, wherein the return comprises a first cam follower, a first pivot shaft, and a claw supported pivotably around the first pivot shaft and configured to return the second sheet toward the sheet support, the drive transmission comprises a first cam configured to drive the return by engaging with the first cam follower and rotating, the regulator comprises a second pivot shaft that is parallel to the first pivot shaft and a regulating member supported pivotably around the second pivot shaft, the regulating member comprising the regulating surface, and the regulating member is arranged such that at least a portion of the regulating member is overlapped with the claw in an axial direction of the second pivot shaft.

2. The sheet feeding apparatus according to claim 1, further comprising an inclined plane configured to be inclined with respect to a sheet feeding direction and the stacking direction, and configured to slide against the first sheet and the second sheet fed by the rotary feeder.

3. The sheet feeding apparatus according to claim 2, wherein the regulating surface is protruded from the inclined plane in the stacking direction when viewed in an axial direction of a rotation shaft of the rotary feeder in a state where the regulator is positioned at the regulating position.

4. The sheet feeding apparatus according to claim 1, wherein the return is configured to pivot to a protruded position in which the claw is protruded to a conveyance path through which a sheet passes and to a retreated position in which the claw is retreated from the conveyance path, and the regulator is allowed to pivot from the regulating position to the allowing position by the return pivoting from the protruded position to the retreated position.

5. The sheet feeding apparatus according to claim 4, wherein the return comprises a contact configured to contact the regulating member, and the contact is configured to regulate the regulator from pivoting to the allowing position in a state where the return is positioned at the protruded position.

6. The sheet feeding apparatus according to claim 5, further comprising an urging member configured to urge the regulator such that regulating member contacts the contact.

7. The sheet feeding apparatus according to claim 6, wherein the regulator is configured to pivot from the allowing position to the regulating position against an urging force of the urging member by being pressed by the contact in a case where the return pivots from the retreated position to the protruded position.

8. The sheet feeding apparatus according to claim 1, wherein the claw is supported movably in a radial direction that is orthogonal to an axial direction of the first pivot shaft.

9. The sheet feeding apparatus according to claim 8, wherein the claw is configured to move in the radial direction in a case where a trailing edge of the first sheet or the second sheet passes the claw.

10. The sheet feeding apparatus according to claim 1, wherein the regulator comprises a second cam follower, and the drive transmission portion comprises a second cam that drives the regulator by engaging with the second cam follower and rotating.

11. The sheet feeding apparatus according to claim 10, wherein the return comprises a first pivot shaft, and a claw supported pivotably around the first pivot shaft and configured to return the second sheet toward the sheet support, and the regulator comprises a second pivot shaft that is parallel to the first pivot shaft, and a regulating member supported pivotably around the second pivot shaft, the regulating member comprising the regulating surface.

12. The sheet feeding apparatus according to claim 11, wherein the claw is supported movably in a radial direction orthogonal to an axial direction of the first pivot shaft.

13. The sheet feeding apparatus according to claim 12, wherein the claw is configured to move in the radial direction in a case where a trailing edge of the first sheet or the second sheet passes the claw.

14. An image forming apparatus comprising:

the sheet feeding apparatus according to claim 1; and an image forming unit configured to form an image on a sheet fed by the sheet feeding apparatus.

* * * * *